US012498160B2

(12) United States Patent
Donnelly et al.

(10) Patent No.: US 12,498,160 B2
(45) Date of Patent: Dec. 16, 2025

(54) COLD STORAGE SYSTEMS AND SHELVING ASSEMBLIES THEREFOR

(71) Applicant: Trane Technologies Life Sciences LLC, Davidson, NC (US)

(72) Inventors: Mitchell J. Donnelly, Homen, WI (US); Benjamin T. Irwin, Marietta, OH (US); Garrett M. Favier, Marietta, OH (US)

(73) Assignee: Trane Technologies Life Sciences LLC, Davidson, NC (US)

( * ) Notice: Subject to any disclaimer, the term of this patent is extended or adjusted under 35 U.S.C. 154(b) by 223 days.

(21) Appl. No.: 18/344,613

(22) Filed: Jun. 29, 2023

(65) Prior Publication Data

US 2025/0003672 A1 Jan. 2, 2025

(51) Int. Cl.

| | |
|---|---|
| ***F25D 11/02*** | (2006.01) |
| ***F25D 13/00*** | (2006.01) |
| ***F25D 23/06*** | (2006.01) |

(52) U.S. Cl.

CPC ..... *F25D 11/02* (2013.01); *F25D 13/00* (2013.01); *F25D 23/067* (2013.01)

(58) Field of Classification Search

CPC ..... F25D 11/02; F25D 13/02; F25D 13/00; F25D 23/067; A47F 3/063; A47F 5/0853; A47F 5/0025; A47F 5/0018; A47F 3/142; A01N 1/14

See application file for complete search history.

(56) References Cited

U.S. PATENT DOCUMENTS

| | | | | |
|---|---|---|---|---|
| 821,577 | A | 5/1906 | Athey | |
| 1,630,160 | A | 5/1927 | Bayless | |
| 1,953,836 | A | 4/1934 | Stevens et al. | |
| 2,044,011 | A | 6/1936 | Nones | |
| 2,437,451 | A * | 3/1948 | McKinley | F25D 13/02 312/236 |
| 2,491,145 | A * | 12/1949 | Yoars | F25D 17/06 62/382 |
| 2,784,027 | A | 3/1957 | Temp | |

(Continued)

FOREIGN PATENT DOCUMENTS

| | | |
|---|---|---|
| DE | 3114980 A1 | 10/1982 |
| DE | 29714105 U1 | 11/1997 |

(Continued)

*Primary Examiner* — David J Teitelbaum

(74) *Attorney, Agent, or Firm* — Womble Bond Dickinson (US) LLP

(57) ABSTRACT

An embodiment of a cold storage system includes a chamber defined at least in part by an outer door and a refrigeration assembly operably coupled to the chamber. In addition, the cold storage system includes a metallic shelving assembly positioned in the chamber. The shelving assembly has a plurality of shelves that each include a front lateral frame member, a back lateral frame member, and a guide coupled to and spanning between the front and back lateral frame members. The guide includes a planar, horizontal guide surface. Further, the cold storage system includes a storage pan positioned at least partially above the guide surface. The storage pan includes an elongate runner extending below and along a bottom side of the storage pan. The elongate runner at least partially includes a polymer and is configured to slidably engage the guide surface.

20 Claims, 22 Drawing Sheets

(56) References Cited

U.S. PATENT DOCUMENTS

| | | | | |
|---|---|---|---|---|
| 3,019,620 | A | 2/1962 | Costantini et al. | |
| 4,161,868 | A | 7/1979 | Kennedy et al. | |
| 4,564,118 | A * | 1/1986 | Heyer | B65D 21/086 220/8 |
| 4,936,625 | A | 6/1990 | Pickard et al. | |
| 5,120,118 | A | 6/1992 | Rankin | |
| 5,671,362 | A | 9/1997 | Cowe et al. | |
| 5,947,573 | A | 9/1999 | Tovar et al. | |
| 5,964,492 | A | 10/1999 | Lyon | |
| 6,220,465 | B1 | 4/2001 | Jones | |
| 6,227,636 | B1 * | 5/2001 | Lye | A47F 3/06 312/351 |
| 6,560,973 | B2 | 5/2003 | Jones et al. | |
| 6,695,375 | B1 | 2/2004 | May | |
| 6,971,730 | B2 | 12/2005 | Koons | |
| 7,232,195 | B2 | 6/2007 | Yang | |
| 7,299,934 | B2 | 11/2007 | Hardy et al. | |
| 7,770,986 | B1 | 8/2010 | Simaitis | |
| 8,549,871 | B1 | 10/2013 | Lauchnor et al. | |
| 8,851,588 | B2 | 10/2014 | Ward et al. | |
| 9,078,520 | B2 | 7/2015 | Shoenfeld | |
| RE45,967 | E | 4/2016 | Owen et al. | |
| 9,709,765 | B2 | 7/2017 | Wells et al. | |
| 9,764,325 | B2 | 9/2017 | Davidowitz | |
| 10,174,991 | B2 | 1/2019 | Parkes | |
| 10,578,351 | B1 | 3/2020 | Nuss | |
| 10,655,905 | B2 | 5/2020 | Candido et al. | |
| 10,823,488 | B2 | 11/2020 | Parkes | |
| 2004/0154322 | A1 | 8/2004 | Felder et al. | |
| 2006/0032827 | A1 * | 2/2006 | Phoy | A47F 1/12 211/74 |
| 2006/0053825 | A1 * | 3/2006 | Owen | A01N 1/145 62/371 |
| 2007/0126325 | A1 | 6/2007 | Gorz et al. | |
| 2012/0153791 | A1 | 6/2012 | Green | |
| 2016/0153703 | A1 | 6/2016 | Jones | |
| 2016/0153704 | A1 | 6/2016 | Burke et al. | |
| 2018/0268353 | A1 | 9/2018 | Sugahara et al. | |
| 2018/0312323 | A1 * | 11/2018 | North | B65D 81/3818 |
| 2019/0051090 | A1 * | 2/2019 | Goldberg | B62D 63/04 |
| 2021/0209763 | A1 | 7/2021 | Wang et al. | |
| 2022/0252323 | A1 | 8/2022 | Thoen | |

FOREIGN PATENT DOCUMENTS

| | | | |
|---|---|---|---|
| EP | 1121290 | A1 | 8/2001 |
| WO | 2022161603 | A1 | 8/2022 |

* cited by examiner

COLD STORAGE SYSTEMS AND SHELVING ASSEMBLIES THEREFOR

CROSS-REFERENCE TO RELATED APPLICATIONS

Not applicable.

TECHNOLOGICAL FIELD

This disclosure generally relates to cold storage systems and related assemblies. More particularly, this disclosure relates to shelving assemblies for use in ultra-low temperature cold storage systems.

BACKGROUND

Cold storage devices, such as refrigerators, freezers, and the like may be used to store goods or other materials at temperatures that are lower than ambient conditions. For life-science products and materials, such as vaccines, biological samples, or other related materials, it is paramount that a cold storage system maintain desired environmental parameters (such as temperature, relative humidity, etc.) to avoid degradation or spoiling.

Cold storage devices may achieve temperatures and humidity levels within an inner storage chamber thereof that are notably lower than the surrounding ambient environment. As a result, when an outer door of the inner storage chamber is opened and the chamber is exposed to the surrounding ambient environment, the temperature of the chamber may rise above a desired level, and ice may begin to form on one or more surfaces therein (e.g., due to the relatively higher humidity levels associated with the ambient conditions).

BRIEF SUMMARY

Some embodiments disclosed herein are directed to a cold storage system. In some embodiments, the cold storage system includes a chamber defined at least in part by an outer door and a refrigeration assembly operably coupled to the chamber. The refrigeration assembly is configured to reduce a temperature within the chamber to −50° F. or lower. In addition, the cold storage system includes a metallic shelving assembly positioned in the chamber. The shelving assembly has a plurality of shelves that each includes a front lateral frame member, a back lateral frame member, and a guide coupled to and spanning between the front lateral frame member and the back lateral frame member. The guide includes a planar, horizontal guide surface. Further, the cold storage system includes a storage pan positioned at least partially above the guide surface. The storage pan includes an elongate runner extending below and along a bottom side of the storage pan. The elongate runner at least partially comprises a polymer and is configured to slidably engage the guide surface.

In some embodiments, the cold storage system includes a housing that defines a chamber. The housing includes an outer door configured to provide access into the chamber. In addition, the cold storage system includes a refrigeration assembly coupled to the housing that is configured to achieve an ultra-low temperature within the chamber via forced convection, and a plurality of shelves vertically spaced from one another within the chamber to provide airflow gaps between the shelves. Each shelf of the plurality of shelves includes a plurality of lateral guides that are laterally spaced from one another to define airflow openings vertically through each shelf individually. Further, the cold storage system includes a plurality of interior doors positioned within the chamber. Each of the plurality of interior doors being aligned with a corresponding shelf of the plurality shelves and configured to transition between: a closed position in which the interior door occludes the corresponding shelf and obstructs airflow from the corresponding shelf out of the chamber when the outer door is open; and an open position in which the interior door is pivoted from the closed position to expose the corresponding shelf. Still further, the cold storage system includes a plurality of storage pans supported on the plurality of guides in each of the plurality of shelves. Each of the plurality of storage pans is configured to slide out from the corresponding shelf to be at least partially supported by a corresponding interior door of the plurality of interior doors when the corresponding interior door is in the open position.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

As previously described, a cold storage system may suffer from undesirable temperature rise and ice formation when an outer door of the inner storage chamber is opened (e.g., to allow insertion of, withdraw of, or access to items stored therein). These issues are exacerbated as the temperature within the inner storage chamber is decreased relative to the ambient environment. For instance, as used herein, the phrase "ultra-low temperature" refers to temperatures that are about −50° F. or lower. When a cold storage system is configured to achieve an ultra-low temperature within the inner storage chamber, the differences in temperature between the inner storage chamber and the surrounding ambient environment are so drastic that even a brief exposure of the inner storage chamber to the surrounding environment (e.g., via the opening of an outer door) can cause significant temperature fluctuations in the inner storage chamber and ice formation that may prevent (or at least restrict) movement of components (e.g., such as shelves or storage racks) positioned therein.

Accordingly, embodiments disclosed herein are directed to cold storage systems that include shelving assemblies configured to help maintain a desired temperature in an inner storage chamber when an outer door of the inner storage chamber is opened. In addition, the shelving assemblies of the embodiments disclosed herein may also be configured to maintain freedom of movement of moving components thereof, even when ice formation occurs. Thus, the embodiments disclosed herein may enhance the functional performance of a cold storage system, and especially cold storage systems that are configured to achieve ultra-low temperatures.

Figure 1:
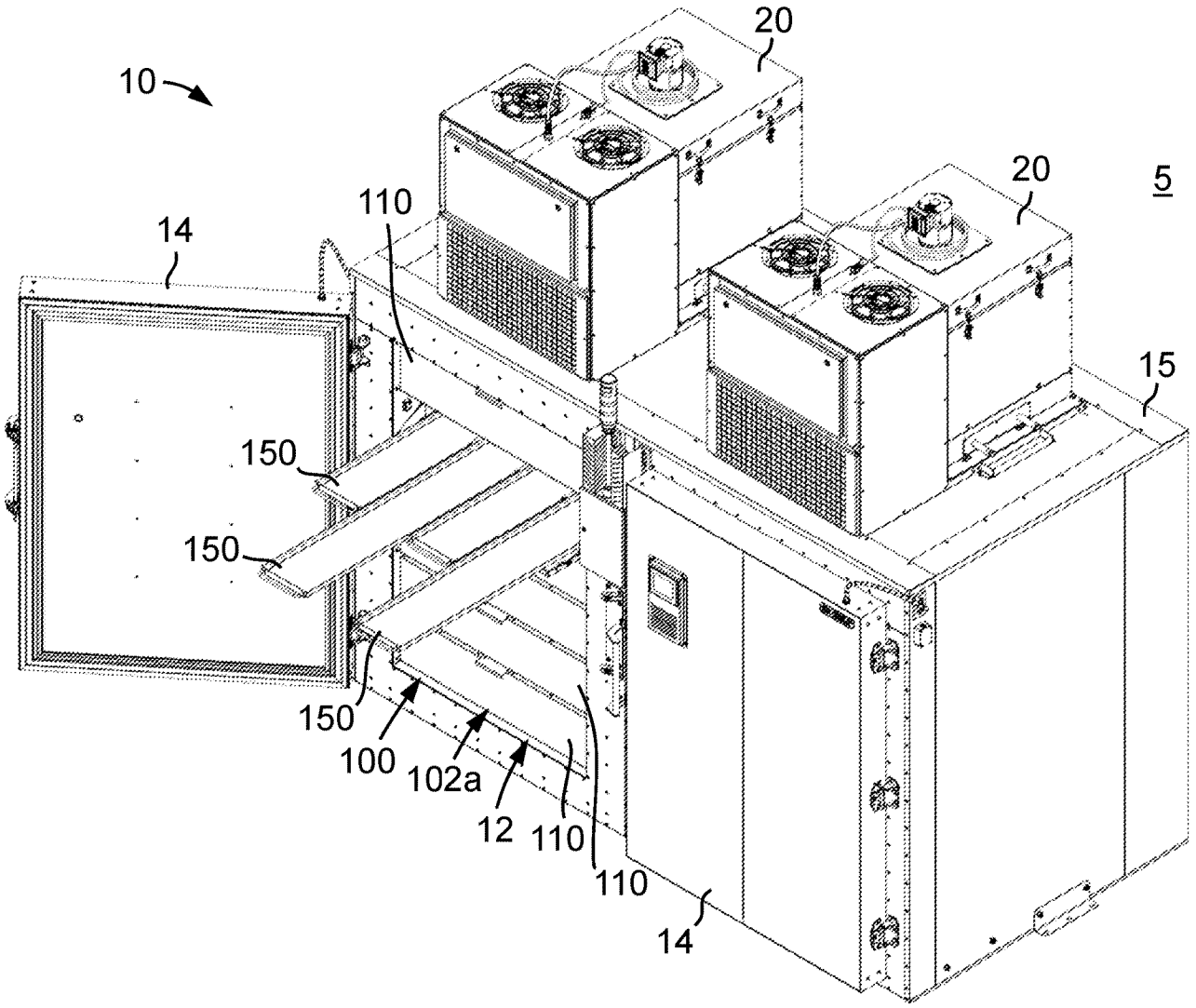
FIG. 1 is a perspective view of a cold storage system according to some embodiments disclosed herein.

FIG. 1 shows a cold storage system 10 according to some embodiments disclosed herein. The cold storage system 10 includes a housing 15 that defines one or more inner storage chambers 12 (or more simply "chamber" or "chambers"). In particular, in the embodiment illustrated in FIG. 1, the housing 15 defines a single chamber 12 that is accessible via a pair of external doors 14. Thus, the chamber 12 is at least partially defined by the external doors 14. When both of the doors 14 are closed, the chamber 12 is isolated or closed-off from the surrounding environment 5, and when one or both of the doors 14 is/are opened, the chamber 12 is exposed to the surrounding environment 5. In some embodiments, the cold storage system 10 may define a pair of chambers 12, and each of the external doors 14 may provide access into a corresponding one of the pair of chambers 12.

In addition, the cold storage system 10 includes one or more refrigeration assemblies 20 that are operably coupled to the chamber 12. Specifically, the chamber 12 may include a pair of refrigeration assemblies 20 that is configured to achieve and/or maintain a desired temperature (or temperature range) within the chamber 12 during operations. In particular, the pair of refrigeration assemblies 20 may provide a redundant system so that one of the refrigeration assemblies 20 may be operated to achieve and/or maintain a desired temperature within the chamber 12, while the other of the refrigeration assemblies 20 is idle. Without being limited to this or any other theory, the redundant system formed by the pair of refrigeration assemblies 20 may allow one of the refrigeration assemblies 20 to undergo a defrost or even a maintenance operation, while the other of the refrigeration assemblies 20 is operated to achieve or maintain a desired temperature in the chamber 12.

Figure 2:
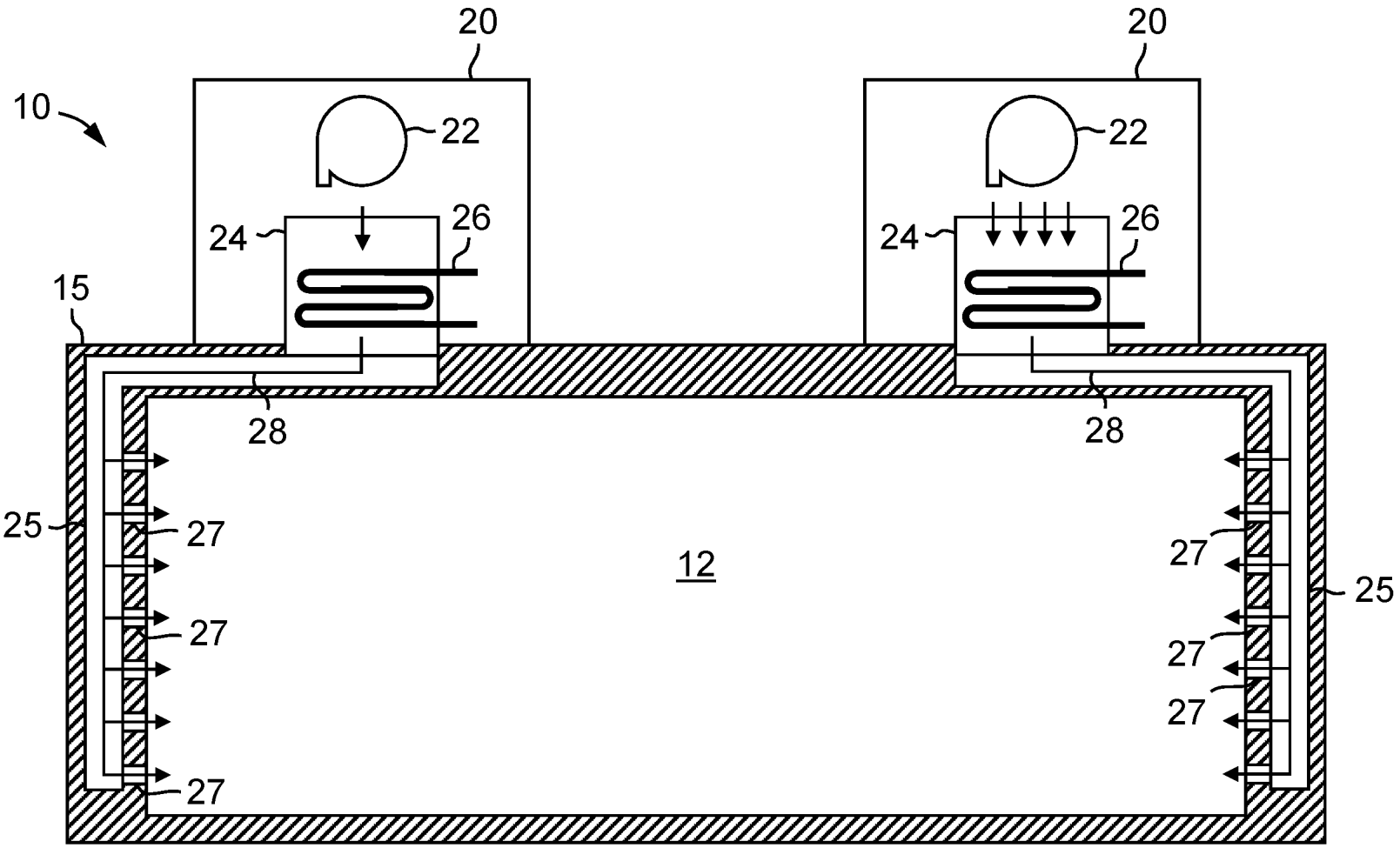
FIG. 2 is a schematic view of the cold storage system of FIG. 1 according to some embodiments disclosed herein.

FIG. 2 is a schematic illustration of the cold storage system of FIG. 1 according to some embodiments. In some embodiments, the refrigeration assemblies 20 may be configured to achieve and/or maintain a low temperature (e.g., such as an ultra-low temperature) within the chamber 12 via forced convection. Specifically, each of the refrigeration assemblies 20 may include a blower 22 that induces an airflow 28 over a coil bank 26 positioned within a duct 24. A heat transfer fluid may circulate through the coil bank 26 at a low temperature so that the temperature and humidity of the airflow 28 may be decreased as the airflow 28 flows over and through the coil bank 26. In some embodiments, the coil bank 26 may circulate the heat transfer fluid after it has been vaporized (or evaporated) via a suitable expander or other component, so that the coil bank 26 may comprise an "evaporator coil" of the refrigeration assembly 20.

After the airflow progresses over and/or through the coil bank 26, the now cold and dry airflow 28 may then be directed through the duct 24 and into the chamber 12 as to lower and/or maintain a desired temperature therein. For instance, in some embodiments, the duct 24 may define one or more manifolds 25 that extend vertically along one or more side walls of the chamber 12. A plurality of inlets 27 may extend from each of the one or more manifolds 25 into the chamber 12 so that the cold and dry airflow 28 may enter the chamber 12 at several vertical elevations in a generally horizontal direction via the inlets 27 (e.g., the airflow 28 may enter the chamber 12 at locations that are vertically positioned between the shelves 104 of the shelving assembly 100 as described in more detail below).

In some embodiments, the heat transfer fluid circulated through the coil bank 26 may comprise one or more refrigerants that may comprise hydrofluorocarbons (HFCs), chlorofluorocarbons (CFCs), hydrochlorofluorocarbons (HCFCs), fluorocarbons (FCs), hydrocarbons (HCs), Ammonia ($NH_3$), carbon dioxide ($CO_2$), or some combination thereof. In addition, it should be appreciated that the refrigeration assemblies 20 may include additional components for the circulation and handling of the heat transfer fluid, such as, for instance, one or more compressor(s), valves, expanders, tubing, condensers. Thus, each of the refrigeration assemblies 20 may define one or more complete refrigeration cycles for the heat transfer fluid. These additional components are not shown in FIG. 2 so as to simplify the drawings and the corresponding description.

In some embodiments, the refrigeration assemblies 20 (or one of the refrigeration assemblies 20) may comprise a so-called cascade refrigeration system, wherein multiple refrigeration cycles are defined therein to lower the temperature of the heat transfer fluid circulated through the coil bank 26 and therefore also the airflow 28 during operations. Thus, in some embodiments, each of the refrigeration assemblies may comprise multiple refrigeration cycles (some of which may employ different refrigerants therein).

Because the pair of refrigeration assemblies 20 form a redundant system in the embodiment of FIGS. 1 and 2, as previously described the refrigeration assemblies 20 may be at least partially connected or integrated with one another. For instance, in some embodiments, the refrigeration assemblies 20 may induce an airflow 28 into the chamber 12 via a common or shared duct 24. However, in some embodiments, the refrigeration assemblies 20 and the associated ducting (e.g., ducts 24) may be entirely separate.

Referring again to FIG. 1, one or more shelving assemblies 100 are positioned within the chamber 12 that are configured to hold and support goods, or other items therein. In the embodiment illustrated in FIG. 1, a pair of shelving assemblies 100 are positioned within the chamber 12 so that each shelving assembly 100 is aligned with a corresponding one of the outer doors 14. In some embodiments, each shelving assembly 100 may be configured to store life science materials, such as vaccines or biological materials in relatively uniform containers (see containers 16 shown in FIG. 5 and described below). In some embodiments, each shelving assembly 100 may be configured to hold and support at least about 1,500 pounds (Lbs.) to about 2,000 Lbs. of materials thereon during operations.

Figure 3:
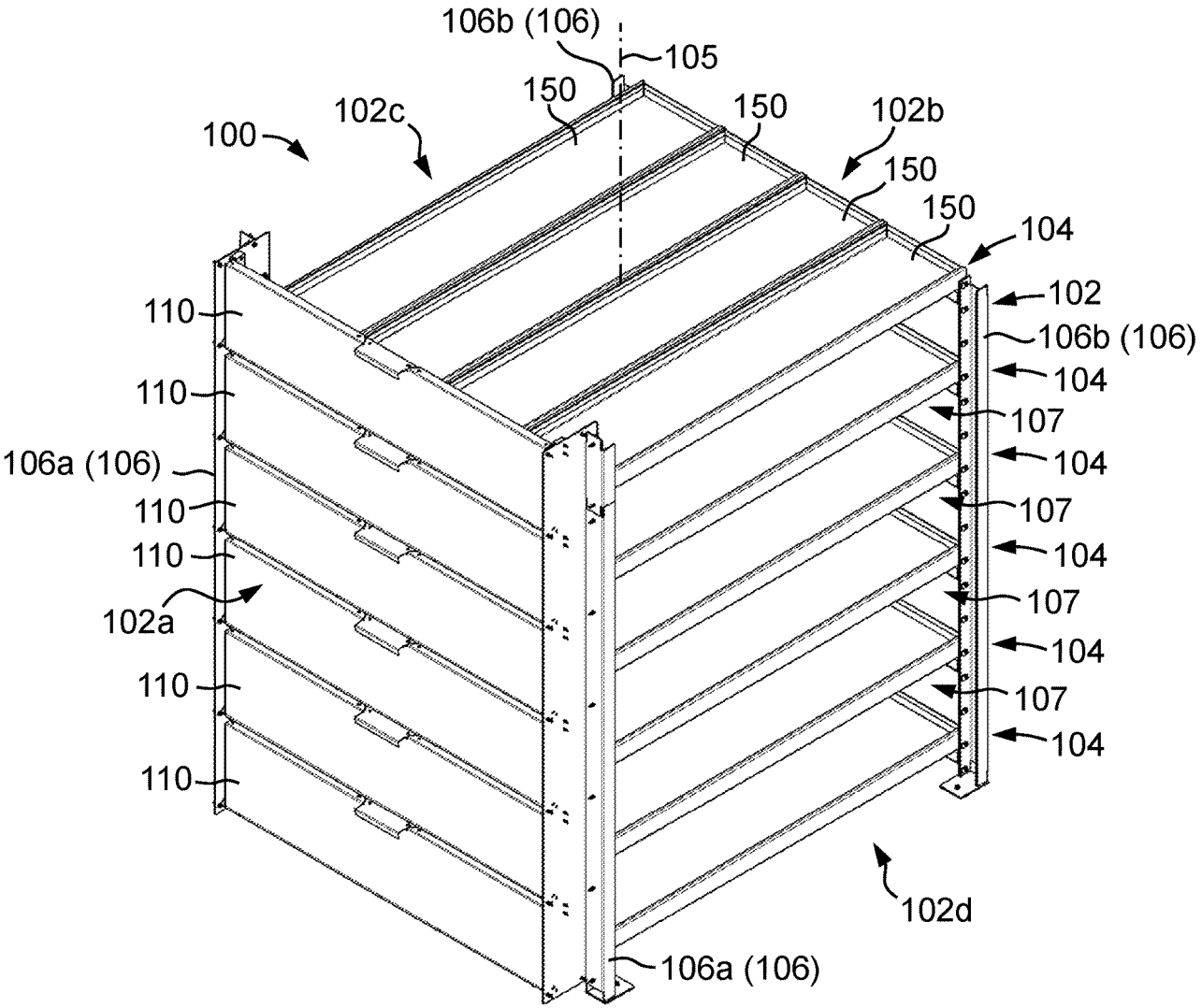
FIG. 3 is a perspective view of a shelving assembly for use within the cold storage system of FIG. 1 according to some embodiments disclosed herein.
Figure 4:
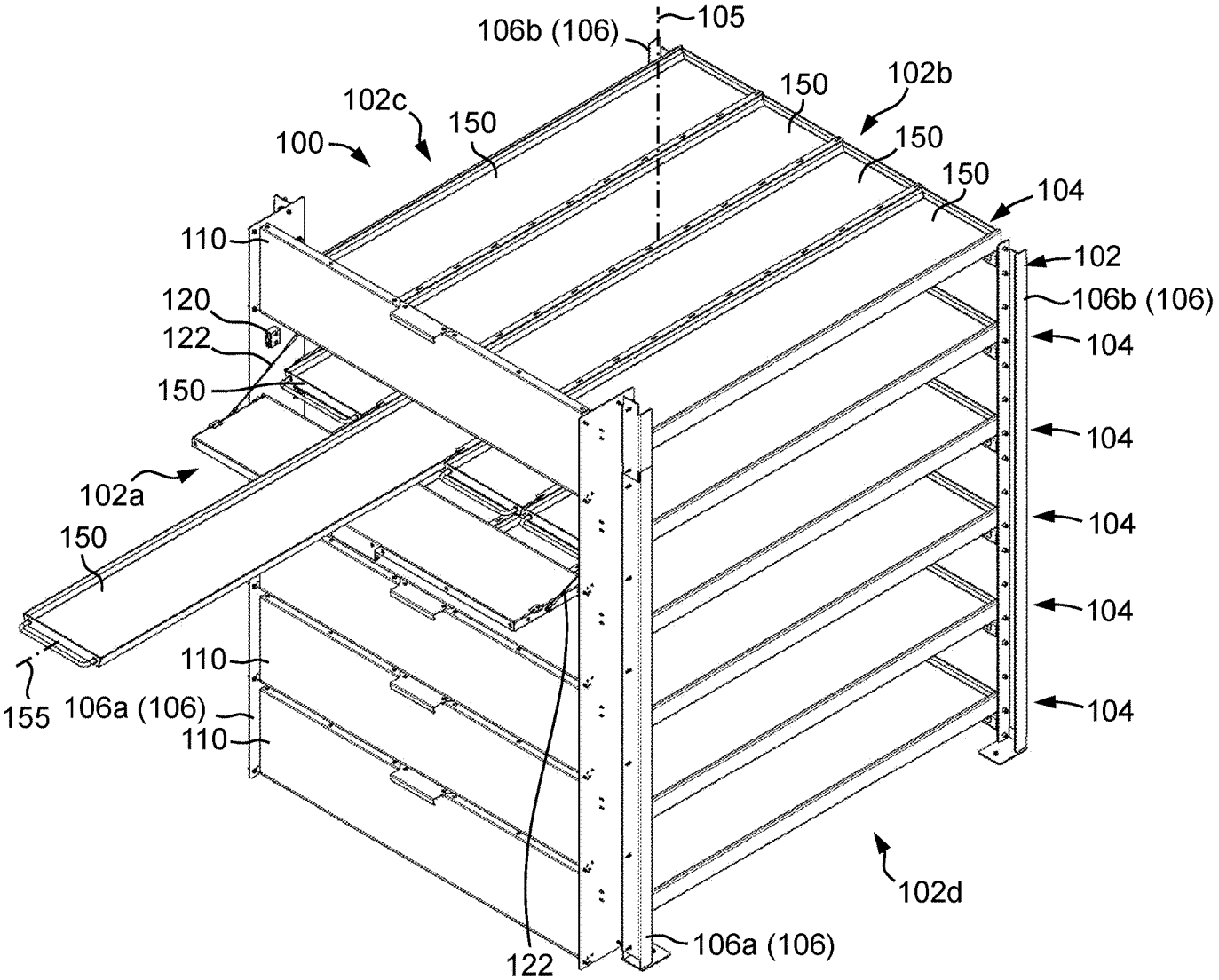
FIG. 4 is another perspective view of the shelving assembly of FIG. 3, showing one or more storage pans pulled out for access according to some embodiments disclosed herein.

Referring now to FIGS. 3 and 4, the shelving assembly 100 is shown according to some embodiments. The shelving assembly 100 generally includes a frame 102 that defines a front side 102*a*, a back side 102*b* opposite the front side 102*a*, a first lateral side 102*c*, and a second lateral side 102*d* opposite the first lateral side 102*c*. The first lateral side 102*c* and the second lateral side 102*d* extend between the front side 102*a* and the back side 102*b*. Referring briefly to FIG. 1, when the shelving assembly 100 is positioned within the chamber 12, the front side 102*a* may be proximate to the corresponding door 14 so that a user may access the shelving assembly 100 generally from the front side 102*a* during operations.

Referring again to FIGS. 3 and 4, the frame 102 includes a plurality of vertical frame members 106 that are substantially parallel to a vertical axis 105 that is substantially aligned with the direction of gravity. In the embodiment illustrated in FIGS. 3 and 4, there are a total of four vertical frame members 106—including a pair of first or front vertical frame members 106*a* positioned along the front side 102*a* of frame 102 and a pair of second or back vertical frame members 106*b* positioned along the back side 102*b* of frame 102.

Figure 5:
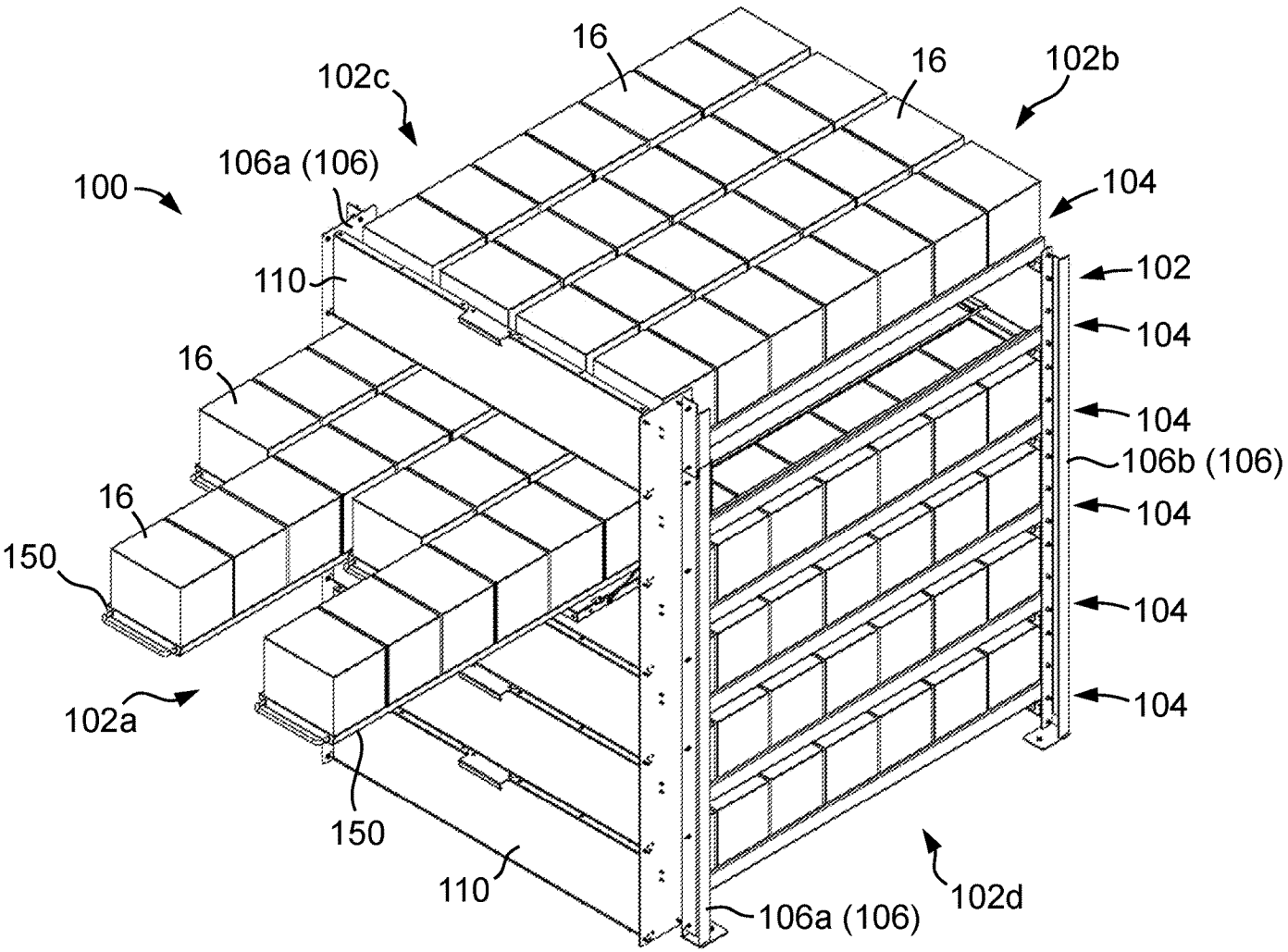
FIG. 5 is another perspective view of the shelving assembly of FIG. 3, showing one or more storage boxes supported thereon according to some embodiments disclosed herein.

The frame 102 also defines a plurality of shelves 104 that are spaced from one another along a vertical axis 105 and along the vertical frame members 106*a*, 106*b*. Each shelf 104 may support a plurality of storage pans 150 that may be selectively slid or pulled out from the shelf 104 along the front side 102*a* of the frame 102. As shown in FIG. 5, each storage pan 150 may hold or support a plurality of containers 16 (e.g., boxes) of goods or other items (e.g., vaccines, medicines, biological materials, etc.). In addition, as shown in FIG. 3, the plurality of shelves 104 may be vertically spaced along the vertical axis 105 so as to define a plurality of airflow gaps 107 vertically positioned between the shelves 104.

Referring still to FIGS. 3 and 4, the frame 102 further includes a plurality of interior doors 110 that are aligned with the plurality of shelves 104. Each of the plurality of doors 110 may (when closed) occlude a corresponding one of the shelves 104 at or along the front side 102*a*. Thus, as shown in FIGS. 1 and 4, a user may first open the corresponding interior door 110 before sliding out one or more of the storage pans 150 on the corresponding shelf 104 during operations.

Figure 6:
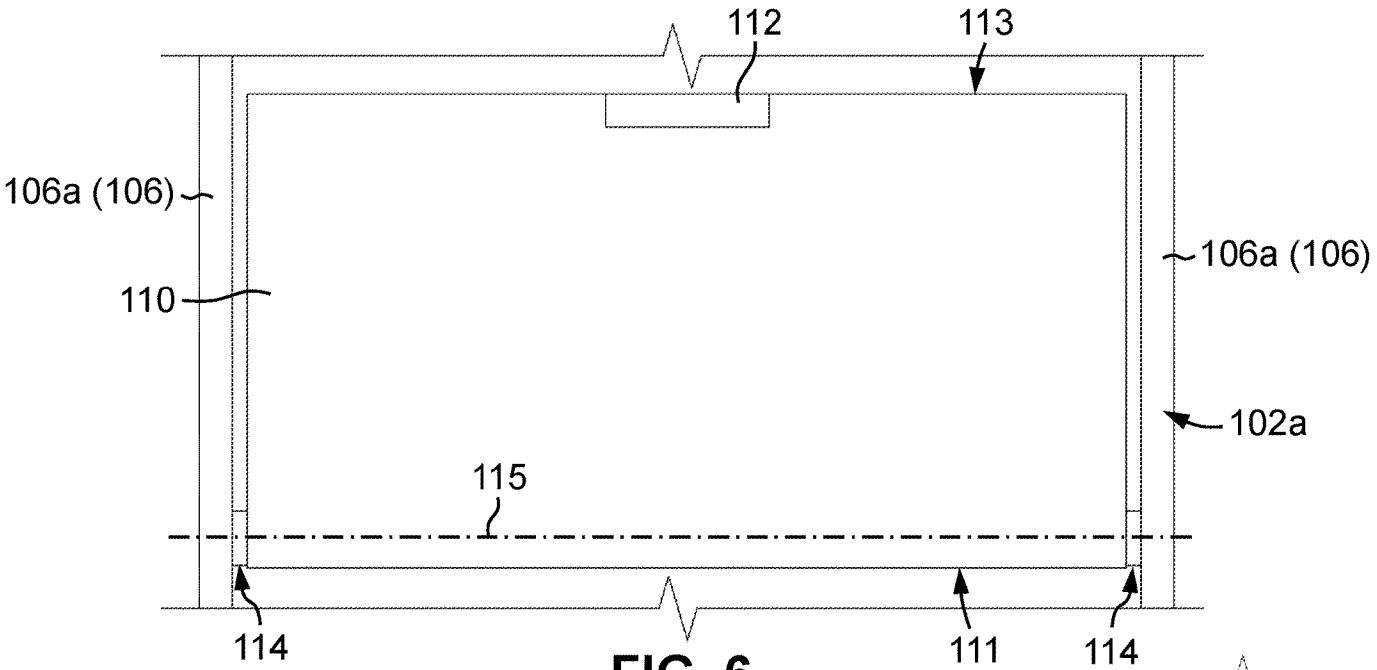
FIG. 6 is a front view of an interior door of the shelving assembly of FIG. 3 according to some embodiments disclosed herein.

Referring now to FIG. 6, one of the interior doors 110 is shown according to some embodiments. The interior door 110 may include a first or bottom edge 111 and a second or top edge 113. In addition, the interior door 110 may be pivotably coupled between the front vertical frame members 106*a* via a pair of pivot connections 114. The pivot connections 114 are positioned at or proximate to the bottom edge 111 such that the interior door 110 may be pivoted or rotated about an axis of rotation 115 that is positioned along or proximate to the bottom edge 111 during operations. A handle 112 may be defined on or coupled to the interior door 110 at or along the top edge 113. The handle 112 may be grasped by a user to open or close the interior door 110 during operations.

Figure 7:
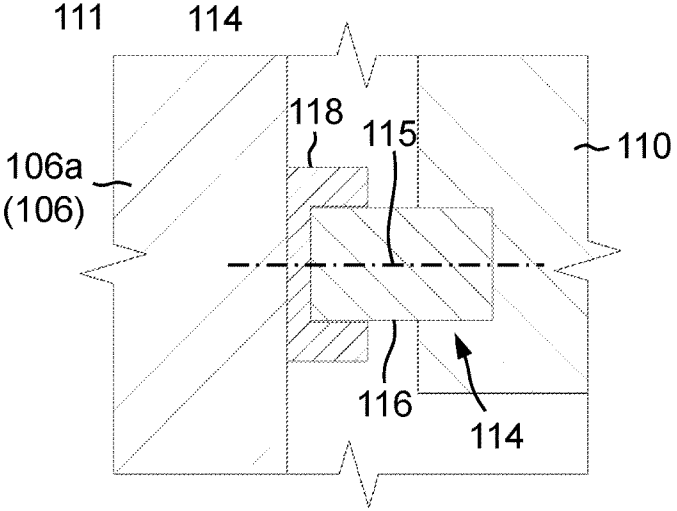
FIG. 7 is an enlarged cross-sectional view of a pivot connection of the interior door of FIG. 6 according to some embodiments disclosed herein.

Referring now to FIG. 7, one of the pivot connections 114 of the interior door 110 of FIG. 6 is shown according to some embodiments. The pivot connection 114 may include a pin or shaft 116 that is coupled to the interior door 110 and that is pivotably received within a socket or receptacle 118 coupled to the corresponding one of the front vertical frame members 106*a*. Referring briefly to FIGS. 6 and 7, the pins 116 of each of the pivot connections 114 may comprise a single continuous pin or shaft that extends through the interior door 110 along the axis of rotation 115. Alternatively, each of the pivot connections 114 may comprise a separate pin 116 that is couped to and extends outward form the interior door 110 along the axis of rotation 115. Regardless, during operations, the pin(s) 116 of the pivot connections 114 may be rotated within the corresponding sockets 118 of the pivot connections 114 to allow the interior door 110 to rotate about the axis of rotation 115 during operations.

Figure 8:
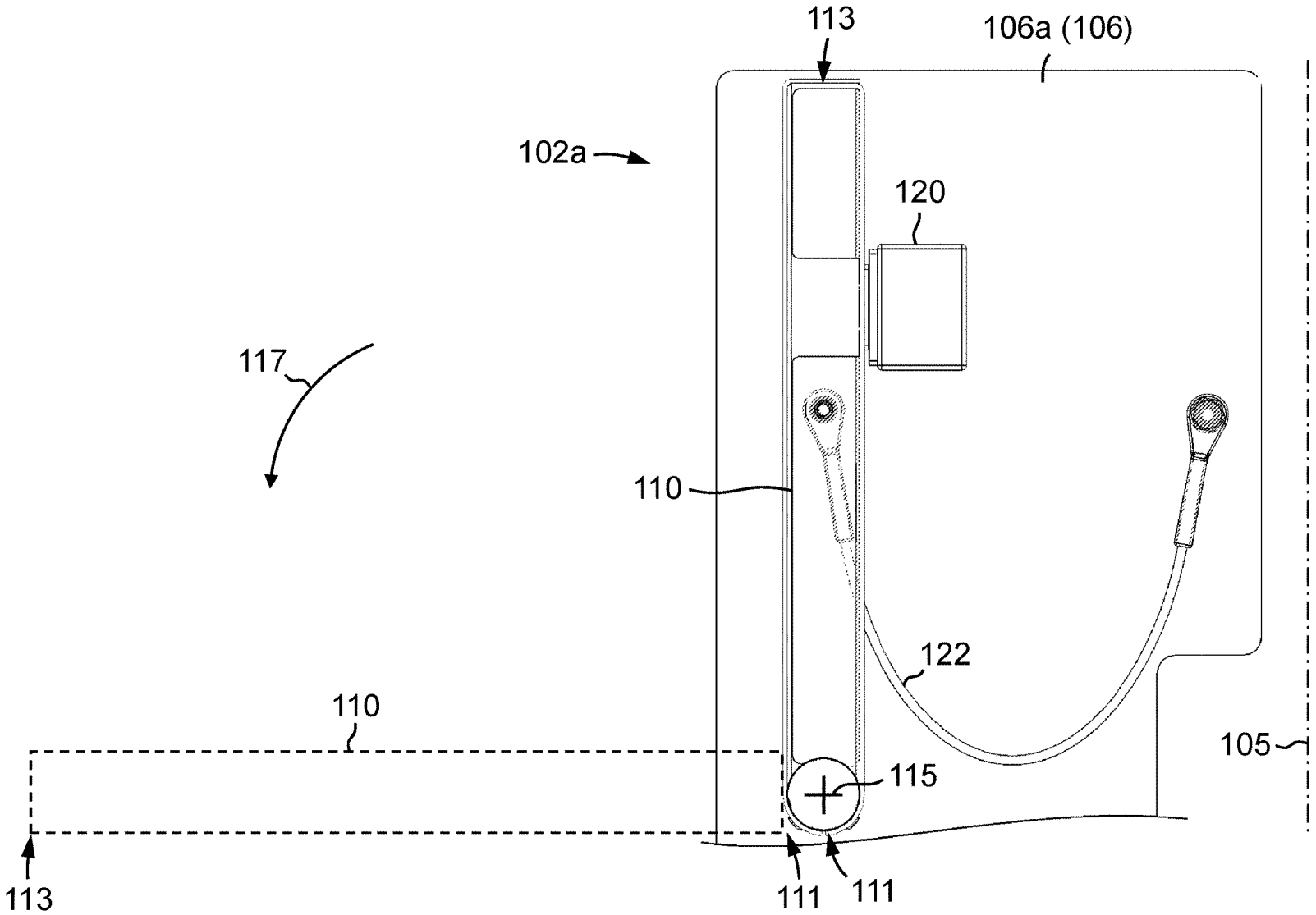
FIG. 8 is a side, cross-sectional view of the interior door in FIG. 6 according to some embodiments disclosed herein.

In particular, with reference to FIG. 8, during operations, the interior door 110 may be pivoted or rotated about the axis of rotation 115 to transition between a first or closed position (shown in solid line in FIG. 8) and a second or open position (shown in dotted line in FIG. 8). In the closed position, the interior door 110 may be rotated about the axis of rotation 115 such that the interior door 110 is generally aligned with or parallel to the front vertical frame members 106*a* (and thus also the vertical direction) with the top edge 113 being positioned generally vertically above the bottom edge 111. In addition, when the interior door 110 is positioned in the closed position, the interior door 110 may occlude or obstruct the corresponding shelf 104 from view along the front side 102*a* of the frame 102 (FIGS. 3 and 4). The interior door 110 may be maintained in the closed position with one or more magnets 120 that are coupled to a corresponding one of the front vertical frame members 106*a*. Specifically, in the illustrated embodiment, the interior door 110 is maintained in the closed position with a pair of magnets 120, with each of the pair of magnets 120 being coupled to a corresponding one of the pair of front vertical frame members 106*a*. However, a single magnet 120 coupled to one of the front vertical frame members 106*a* may be utilized in some embodiments to hold or maintain the interior door 110 in the closed position.

Conversely, when the interior door is in the open position (shown in dotted line in FIG. 8), the interior door 110 may be rotated about the axis of rotation 115 from the closed position such that the top edge 113 is pivoted outward and away from the corresponding shelf 104 to expose the corresponding shelf 104 from the front side 102*a* of frame 102. In the open position, the interior door 110 may be generally oriented in a lateral or horizontal direction (which is generally perpendicular or radial relative to the vertical axis 105). Thus, as is shown in FIG. 4, when the interior door 110 is in the open position (such as is shown for the interior door 110 that is second from the top in FIG. 4), the interior door 110 may provide additional support for a storage pan 150 along the corresponding shelf 104 that is pulled out therefrom. Referring again to FIG. 8, the interior door may be supported and held in the open position against the force of gravity by one or more (e.g., a pair) cables 122 that are each connected to both the interior door 110 and a corresponding one of the front vertical frame members 106*a*. Specifically, in the illustrated embodiments, the interior door 110 may be supported in the open position by a pair of cables 122 that are each coupled to and between the interior door 110 and a corresponding one of the pair of front vertical frame members 106*a*. However, a single cable 122 may be coupled to and between one of the front vertical frame members 106*a* (or a lateral frame member as described in more detail below) to hold or support the interior door 110 in the open position in some embodiments.

Referring again to FIGS. 1, 3, and 4, as previously described, the interior doors 110 may be normally placed in the closed position (FIG. 8) so that when the corresponding outer door 14 of the chamber 12 is opened, air flow (or air exchange) between the chamber 12 and the surrounding ambient environment 5 is greatly impeded or obstructed by the closed interior doors 110. Specifically, the closed interior doors 110 may constrict the volume of air that may flow into or out of the chamber 12 via the open outer door 14, so that the rate of temperature increase within the chamber 12 may be reduced.

Figure 9:
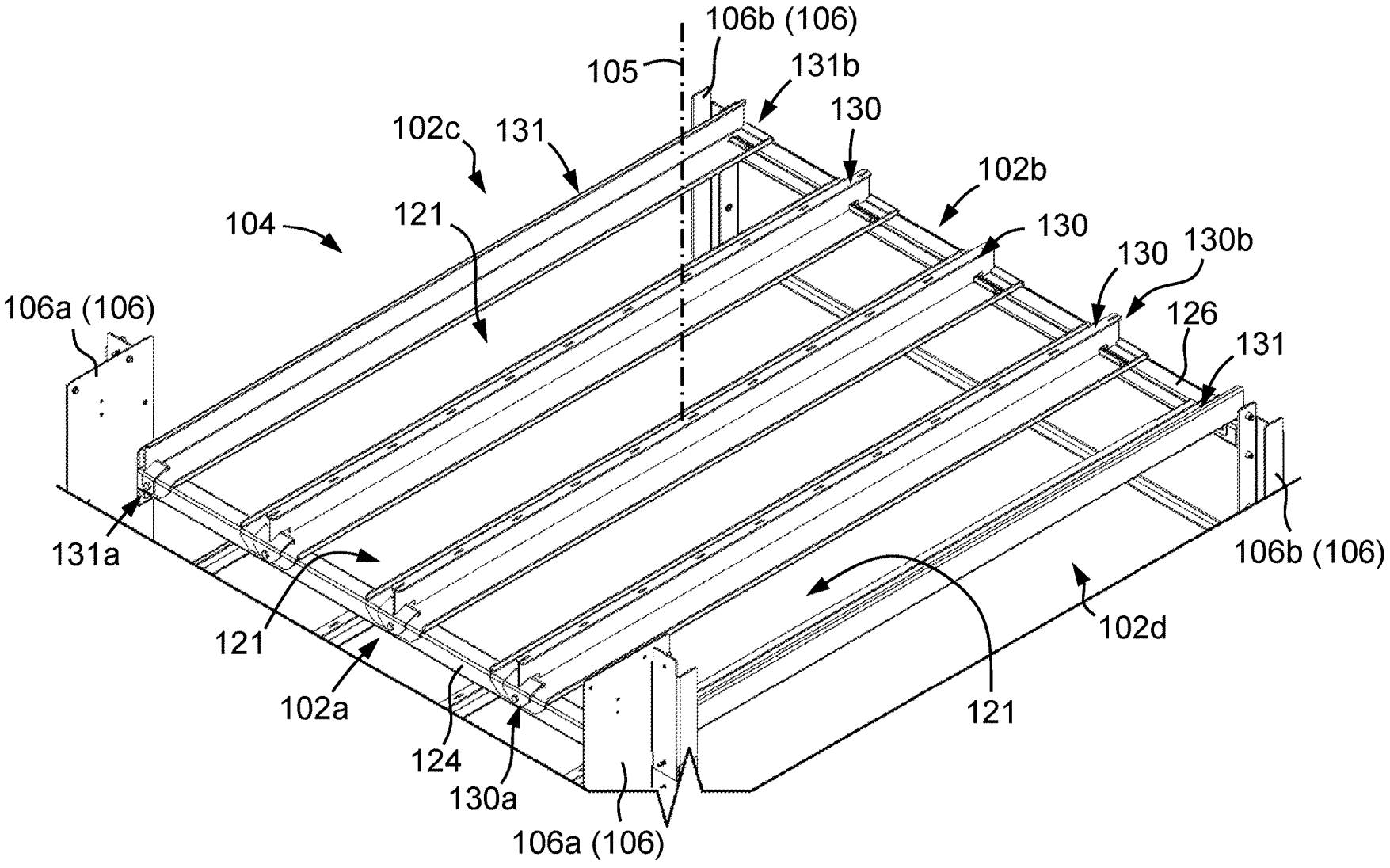
FIG. 9 is a perspective view of one of the shelves of the shelving assembly of FIG. 3 according to some embodiments disclosed herein.

Referring now to FIG. 9, one of the shelves 104 of the shelving assembly 100 is shown according to some embodiments. However, it should be appreciated that each of the plurality of shelves 104 defined on the frame 102 may include the same or similar features to the shelf 104 illustrated in FIG. 9, such that the following description may be applied to describe each of the shelves 108. In FIG. 9, the storage pans 150 are removed from view to better illustrate the features of the illustrated shelf 104. In describing the shelf 104, references to vertical or axial directions mean generally along or parallel to the vertical axis 105, and references to lateral, horizontal, or radial directions mean directions that are generally in or along a plane that extends perpendicularly to the vertical axis 105.

Generally speaking, the shelf 104 includes a first or front lateral frame member 124 that extends horizontally or laterally relative to the vertical axis 105 along the front side 102*a* of the frame 102, and a second back lateral frame member 126 that extends horizontally or laterally relative to the vertical axis 105 along the back side 102*b* of the frame 102. In addition, the shelf 104 includes a plurality of first or central guides 130 and a plurality of second or side guides 131. The guides 130, 131 span horizontally or laterally between the front lateral frame member 124 and the back lateral frame member 126. The side guides 131 are each positioned along corresponding ones of the first lateral side 102*c* and the second lateral side 102*d*, and the central guides 130 are positioned horizontally or laterally between the side guides 131. Thus, the side guides 131 define the lateral limits or edges of the shelf 104 in a horizontal or lateral direction relative to the vertical axis 105.

The guides 130, 131 may be laterally (or horizontally) spaced from one another so as to define a plurality of airflow openings 121 extending vertically through the shelf 104. Without being limited to this or any other theory, the airflow openings 121 and the airflow gaps 107 (FIG. 3) may allow air to move more freely in a vertical and horizontal direction through the shelving assembly 100 so as to facilitate and even enhance the forced convective heat transfer within the chamber 12 that is driven by the corresponding refrigeration assembly 20 (FIG. 1) (and previously described above). The number and spacing of the guides 130, 131 along the shelf 104 may be selected to adjust the size of the airflow openings 121 and to accommodate different numbers and/or lateral sizes of the storage pans 150.

Referring still to FIG. 9, each of the central guides 130 includes a first or front end 130*a* connected to the front lateral fame member 124 and a second or back end 130*b* connected to the back lateral frame member 126. Similarly, each of the side guides 131 includes a first or front end 131*a* connected to the front lateral frame member 124 and a second or back end 131*b* connected to the back lateral frame member 126.

Figure 10:
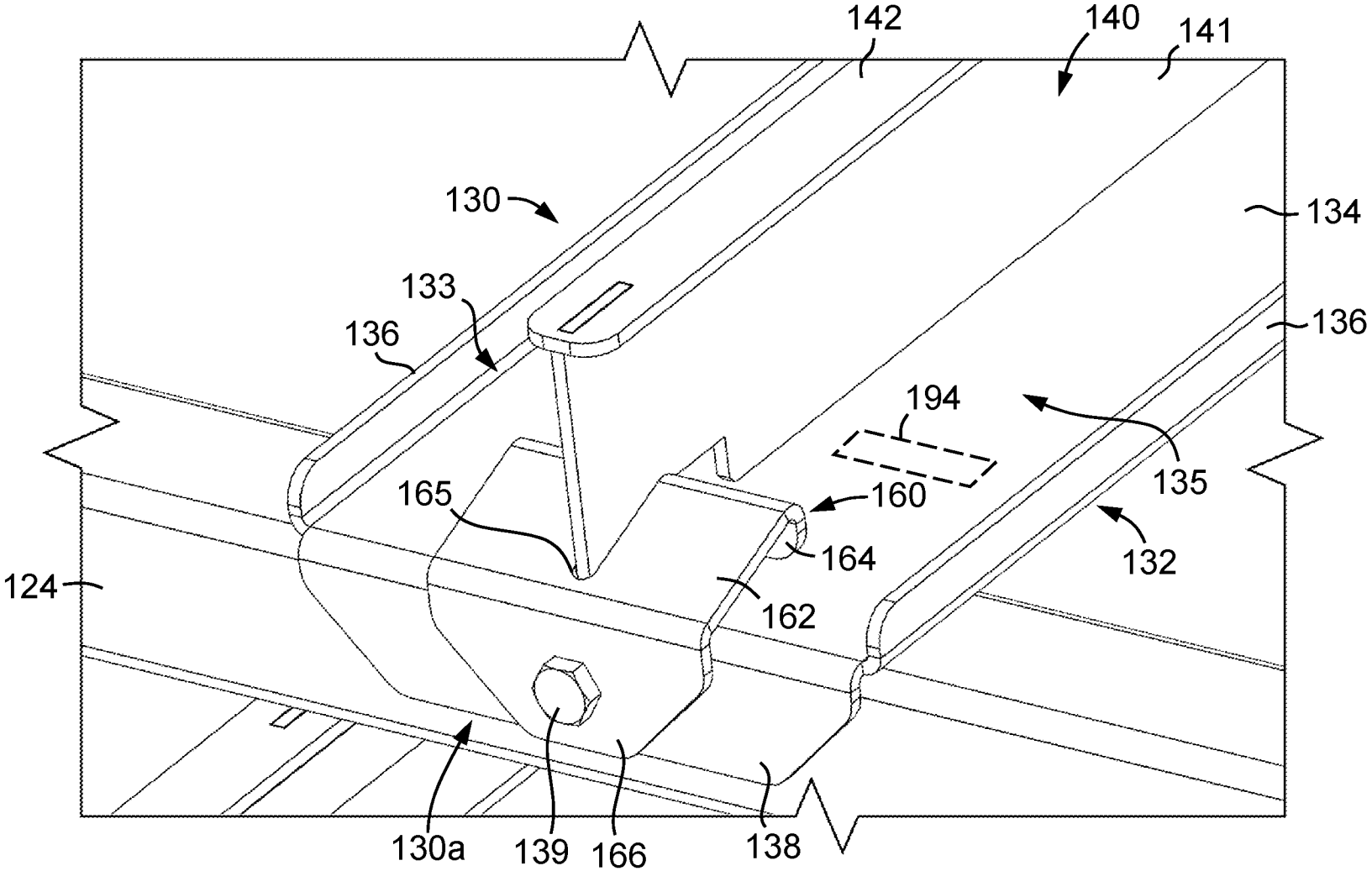
FIG. 10 is a perspective view of a front end of a central guide of the shelf of FIG. 9 according to some embodiments disclosed herein.
Figure 11:
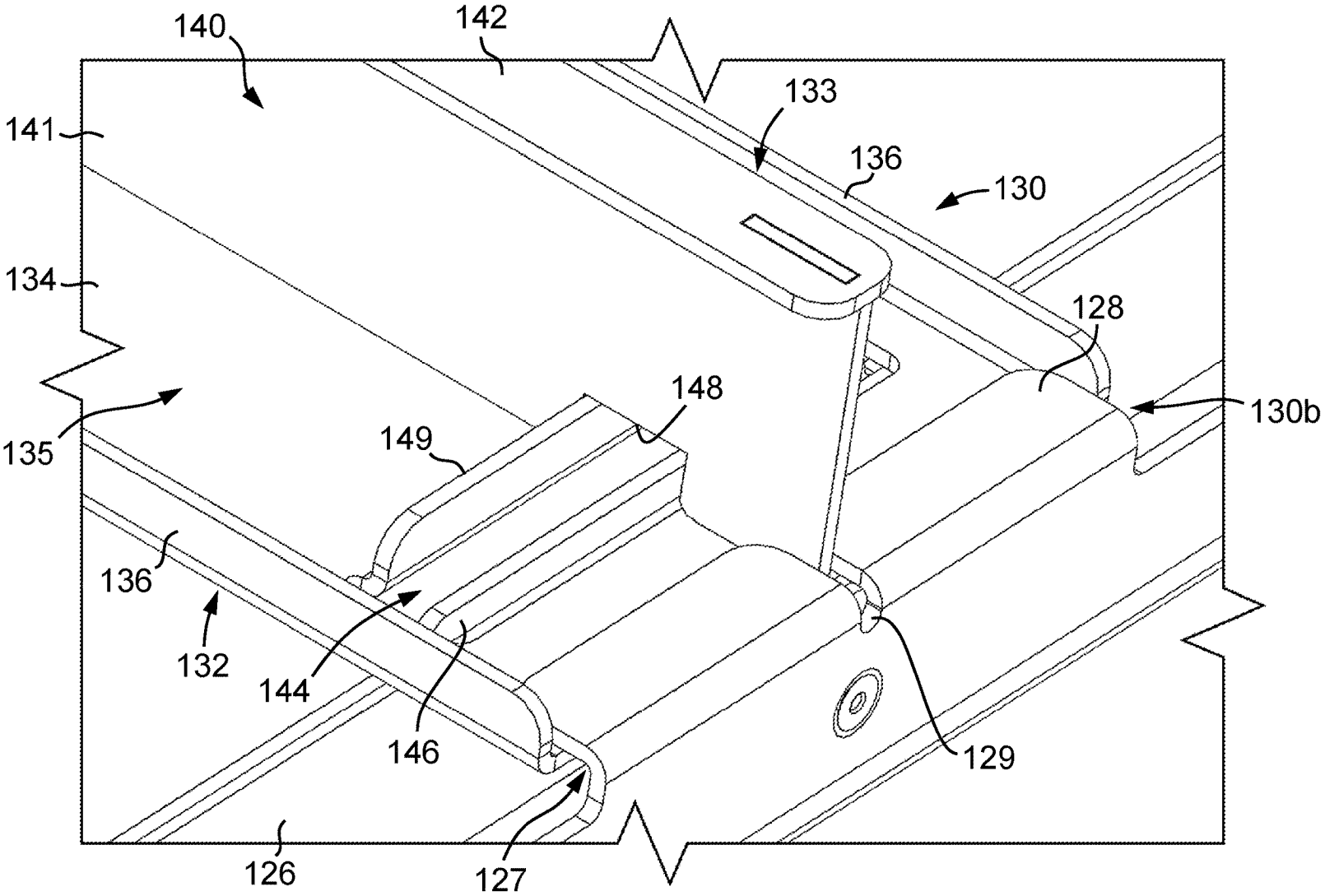
FIG. 11 is a perspective view of a back end of the central guide of FIG. 10 according to some embodiments disclosed herein.

Referring now to FIGS. 10 and 11, the front end 130*a* and back end 130*b*, respectively, of one of the central guides 130 is shown according to some embodiments. However, it should be appreciated that each of the plurality of central guides 130 may include the same or similar features to those illustrated in FIGS. 10 and 11 in some embodiments, such that the following description of one of the central guides 130 may be applied to describe each of the central guides 130.

The central guide 130 includes a base 132 and a flange assembly 140 coupled to and extending vertically upward from the base 132 (relative to the vertical axis 105 shown in FIG. 9). The base 132 includes a planar, horizontal guide surface 134 that extends laterally or horizontally between the ends 130*a*, 130*b*. In addition, a pair of guide walls 136 extend vertically upward from the guide surface 134 on the lateral sides thereof. The guide walls 136 also extend laterally or horizontally between ends 130*a*, 130*b* as shown in FIGS. 10 and 11 relative to the vertical axis 105.

As shown in FIG. 10, a front bracket (or plate) 138 extends vertically downward from the guide surface 134 at the front end 130*a*. A connecting member 139 extends through the front bracket 138 and into the front lateral frame member 124 to secure the guide surface 134 (and thus also the central guide 130) thereto. The connecting member 139 may comprise a bolt, screw, rivet, or any other suitable connecting member. In addition, in some embodiments, the front bracket 138 and/or the guide surface 134 may be welded or otherwise adhered to the front lateral frame member 124.

Referring still to FIGS. 10 and 11, the flange assembly 140 includes a laterally extending flange 142 (or a "lateral flange 142") that is vertically spaced above and coupled to the guide surface 134 via a vertical riser plate 141. In some embodiments, the riser plate 141 and lateral flange 142 extend between the front end 130*a* and the back end 130*b* of the central guide 130. In addition, in some embodiments the riser plate 141 and flange 142 may be substantially laterally spaced equally between the guide walls 136 along the guide surface 134. Thus, the riser assembly 140 separates the central guide 130 into a first lateral side 133 and a second lateral side 135 on opposite lateral sides of the riser plate 141. Specifically, the first lateral side 133 is defined between the riser plate 141 and a first of the guide walls 136, and the second lateral side 135 is defined between the riser plate 141 and a second of the guide walls 136. The flange 142 may extend laterally or horizontally outward from the riser plate 141 along both the first side 133 and the second side 135.

A front stop 160 is coupled to the central guide 130 at the front end 130*a*. Specifically, the front stop 160 includes a bracket (or plate) 166 that is layered over the bracket 138 extending from guide surface 134. In addition, the front stop 160 includes a substantially vertically extending front stop surface 164, and a ramped connection plate 162 that extends between the bracket 166 and the front stop surface 164. The connection member 139 may extend through both the bracket 166 of the front stop 160 and the bracket 138 of the guide surface 134 so as to secure the front stop 160 to the central guide 130 and front lateral frame member 124. In some embodiments, the front stop 160 may be integrally formed with the base 132 or the flange assembly 140. In addition, as shown in FIG. 10, the ramped connection plate 162 and the stop surface 164 may include or define a slot or notch 165 in the front stop 160 that is configured to receive a portion of the riser plate 141 therein.

As shown in FIG. 11, the guide surface 134 includes a vertically extending aperture 144 therethrough that is positioned proximate the back end 130*b* (e.g., such as closer to the back end 130*b* than the front end 130*a*). In particular, the aperture 144 may be generally positioned at or near the back lateral frame member 126. In addition, the riser plate 141 of the flange assembly 140 includes a laterally or horizontally extending aperture or notch 148 that is generally aligned with the aperture 144 along the central guide 130. A vertically upward extending projection 146 defined on or coupled to the back lateral frame member 126 extends vertically upward through the aperture 144 in the guide surface 134 and into the aperture 148 in the riser plate 141. Thus, the engagement between the projection 146 and one of more of the walls or edges defining the aperture 144 and/or the aperture 148 may prevent a lateral shift of the central guide 130 between the front lateral frame member 124 and the back lateral frame member 126.

In addition, one of the walls or edges of the aperture 144 in the guide surface 134 is defined by an upturned, substantially vertically extending back stop surface 149. The stop surface 149 may be integrally formed with the guide surface 134. In particular, the stop surface 149 may be formed as an upward bent portion of the guide surface 134. However, the stop surface 149 may be separately formed and coupled to the guide surface 134 in some embodiments.

Further, a laterally or horizontally extending projection 128 is formed on (or coupled to) the back lateral frame member 126. The projection 128 is vertically spaced above a remaining upper surface of the back lateral frame member 126 so as to form or define a slot 127 vertically positioned therebetween. A portion of the guide surface 134 at the back end 130*b* may be inserted within the slot 127 and vertically under the projection 128 so that the projection 128 may prevent the back end 130*b* of central guide 130 (and particularly the guide surface 134 at the back end 130*b*) from pivoting or lifting upward from the back lateral frame member 126. The projection 128 may have a slot or notch 129 formed therein that is configured to receive a portion of the riser plate 141.

Figure 12:
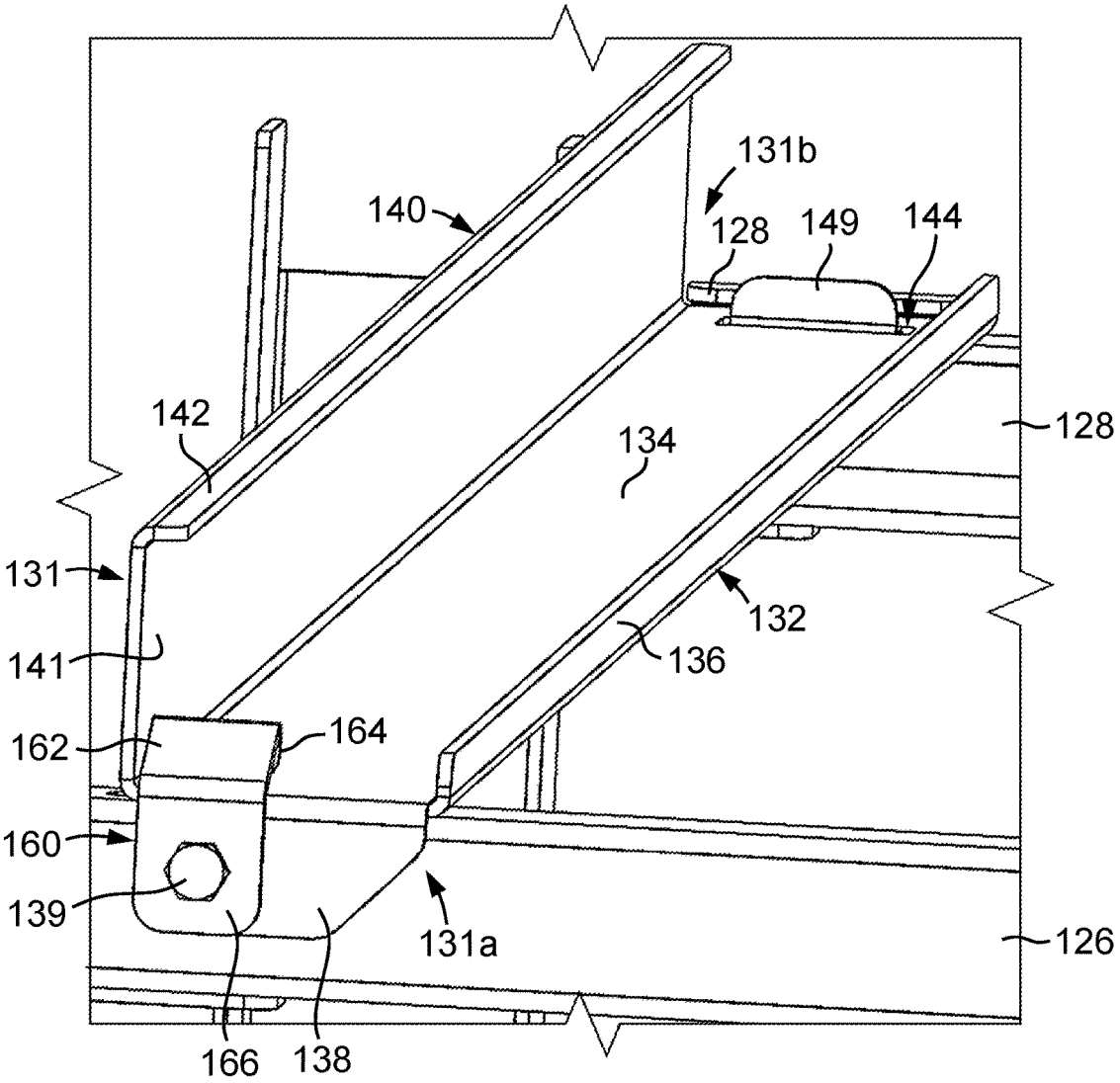
FIG. 12 is a perspective view of a side guide of the shelf of FIG. 9 according to some embodiments disclosed herein.
Figure 13:
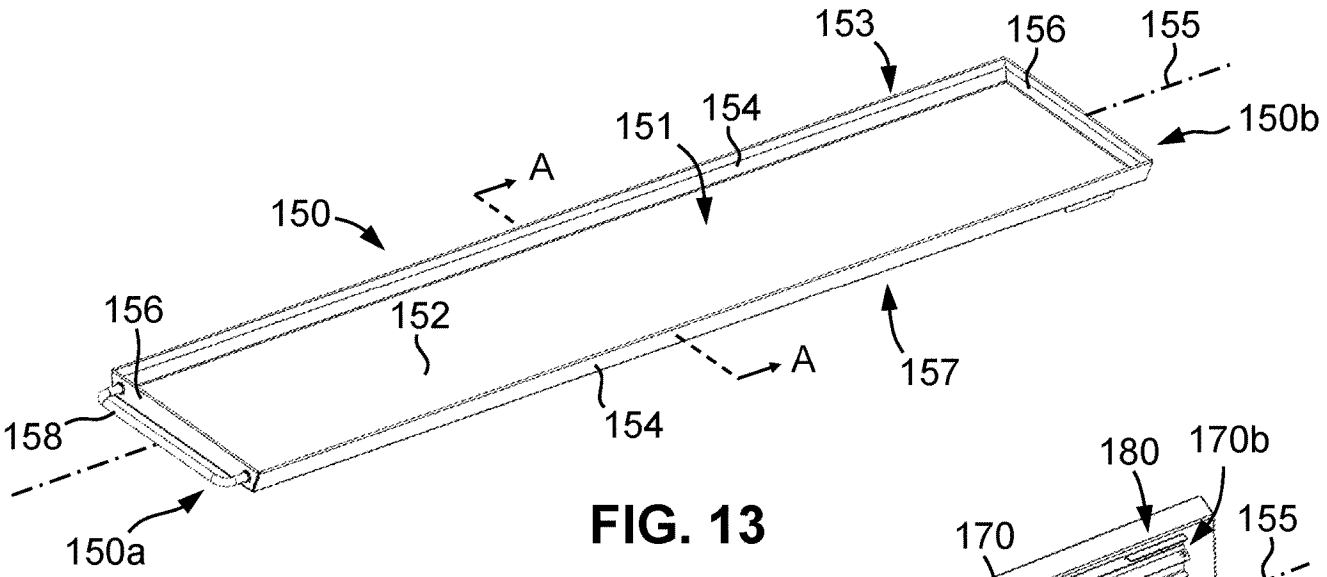
FIG. 13 is a top, perspective view of a storage pan for use with the shelving assembly of FIG. 3 according to some embodiments disclosed herein.

Referring now to FIG. 12, one of the side guides 131 is shown according to some embodiments. However, it should be appreciated that each of the plurality of side guides 131 may include the same or similar features to those illustrated in FIG. 12 in some embodiments, such that the following description of one of the side guide 131 may be applied to describe each of the side guides 131.

The side guide 131 may be generally similar to the central guides 130, previously described. Thus, components of the side guide 131 that are shared with the central guides 130 are identified with the same reference numerals and the description below will focus on the features of the side guide 131 that are different from the central guides 130.

Generally speaking, the side guide 131 includes a single lateral side in place of the two lateral sides 133, 135 previously described for the central guides 130. In particular, the vertical riser plate 141 of the side guide 131 is not centrally located along the guide surface 134 between the pair of guide walls 136. Rather the riser plate 141 is positioned on a lateral edge of the guide surface 134 in place of one of the guide walls 136. In addition, the flange 142 extends from a vertical top of the riser plate 141 toward the opposite, remaining guide wall 136. In some embodiments, the guide surface 134, guide wall 136, riser plate 141, and the flange 142 of the side guide 131 may be integrally formed as a single-piece monolithic body. For instance, the guide surface 134, guide wall 136, riser plate 141, and the flange 142 of the side guide 131 may be formed from a single elongate plate that is bent in several places to define the guide surface 134, guide wall 136, riser plate 141, and the flange 142. Because the riser plate 141 is not centrally located along the guide surface 134 as previously described, the projection 128 and front stop 160 lack the slots 129, 165, respectively (FIGS. 10 and 11) on the side guides 131.

Referring now to FIGS. 13-20, one of the storage pans 150 illustrated in FIGS. 3 and 4 is shown according to some embodiments. However, it should be appreciated that each of the plurality of storage pans 150 may include the same or similar features to those illustrated in FIGS. 3 and 4 in some embodiments, such that the following description of one of the storage pan 150 may be applied to describe each of the storage pans 150.

The storage pan 150 includes a central or longitudinal axis 155, a first or front end 150*a*, and a second or back end 150*b* that is spaced from the front end 150*a* along the longitudinal axis 155. Also, the storage pan 150 includes a first or top side 153 extending axially between the ends 150*a*, 150*b* relative to axis 155 and a second or bottom side 157 extending axially between the ends 150*a*, 150*b* relative to axis 155. As shown in FIG. 4, when the storage pans 150 are supported on the shelving assembly 100, the longitudinal axis 155 may be oriented generally horizontally or laterally relative to the vertical axis 105 and may generally extend parallel to the lateral sides 102*c*, 102*d*.

Referring again to FIGS. 13-20, the storage pan 150 includes a base 152 positioned between the ends 150*a*, 150*b* such that the top side 153 is defined along a first side of the base 152 and the bottom side 157 is defined along a second, opposite side of the base 152. A plurality of walls 154, 156 extending upward from the base 152 along the top side 153. In particular, the storage pan 150 includes a pair of end walls 156 positioned at the front end 150*a* and back end 150*b* that extend in a radial direction from the base 152 relative to the central axis 155 along the top side 153. The storage pan 150 also includes a pair of lateral side walls 154 that extend outward from the base 152 and that extend axially between the pair of end walls 156. Together, the base 152, end walls 156, and lateral side walls 154 define a receptacle 151 on the top side 153 of storage pan 150. A handle 158 is coupled to the end wall 156 on the front end 150*a*.

Additional views of the storage pan 150 are shown in FIGS. 15-19 so as to further illustrate the features thereof. In particular, FIGS. 15-19 include a front view, back view, top view, bottom view, and side view (both the right and left side views are the same), respectively, of the storage pan 150 according to some embodiments.

Figure 20:
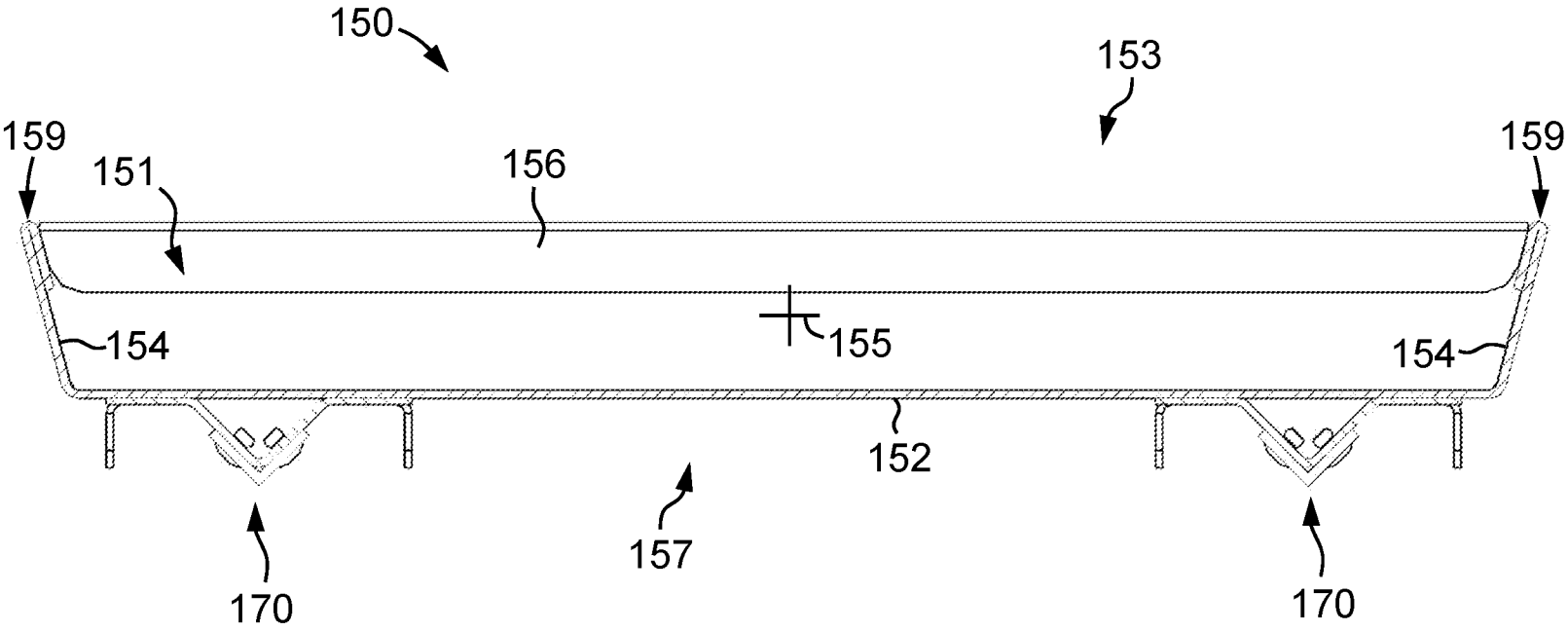
FIG. 20 is a cross-sectional view taken along section A-A in FIG. 13 according to some embodiments disclosed herein.

As shown in FIG. 20, the lateral side walls 154 extend upward and away from the base 152 on the top side 153 to a top edge 159 (or uppermost edge). As the lateral side walls 154 extend upward and away from the base 152 on the top side 153, the lateral side walls 154 also diverge laterally or radially away from one another relative to axis 155. Specifically, each of the lateral side walls 154 diverge radially away from the longitudinal axis 155 as the lateral side walls 154 extend from the base 152 toward to the top edge 159.

Figure 14:
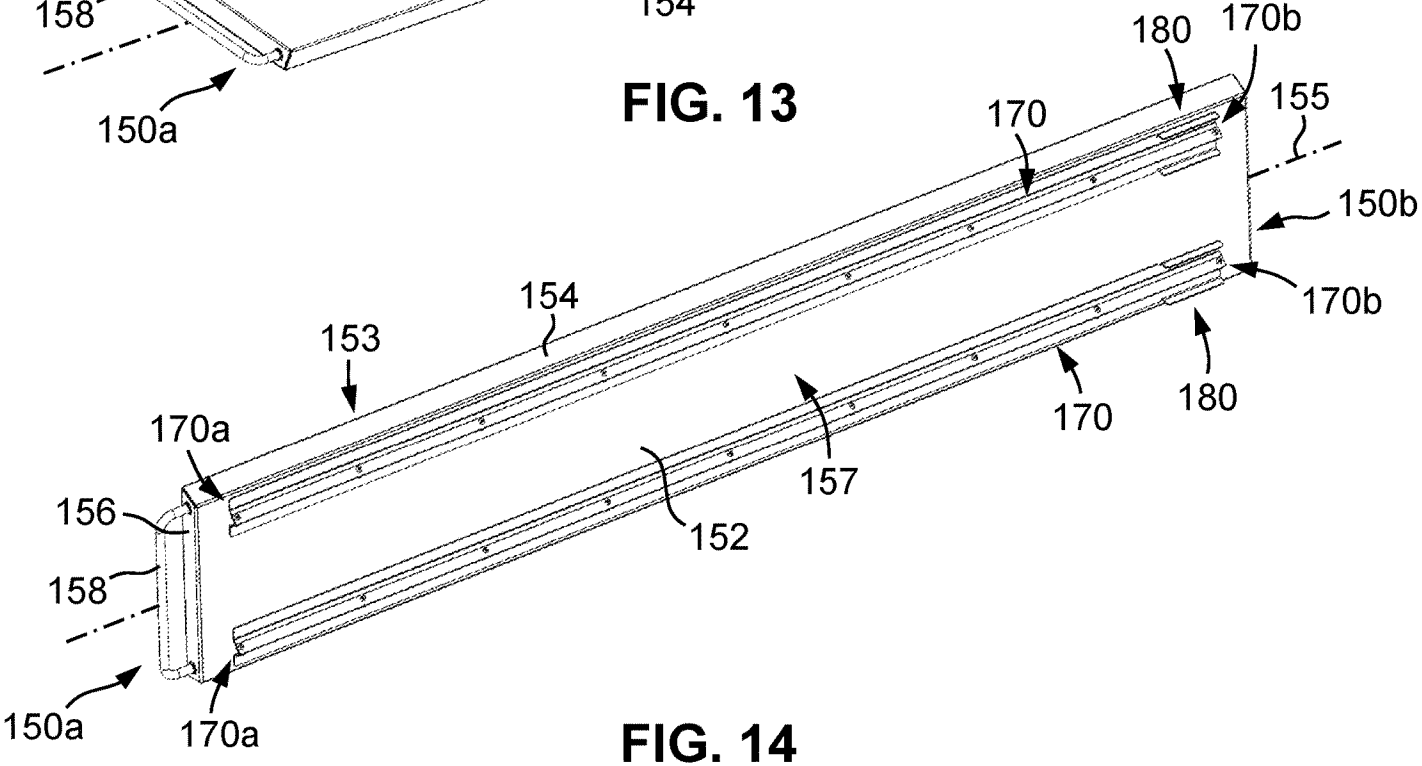
FIG. 14 is a bottom, perspective view of the storage pan of FIG. 13 according to some embodiments disclosed herein.
Figure 15:
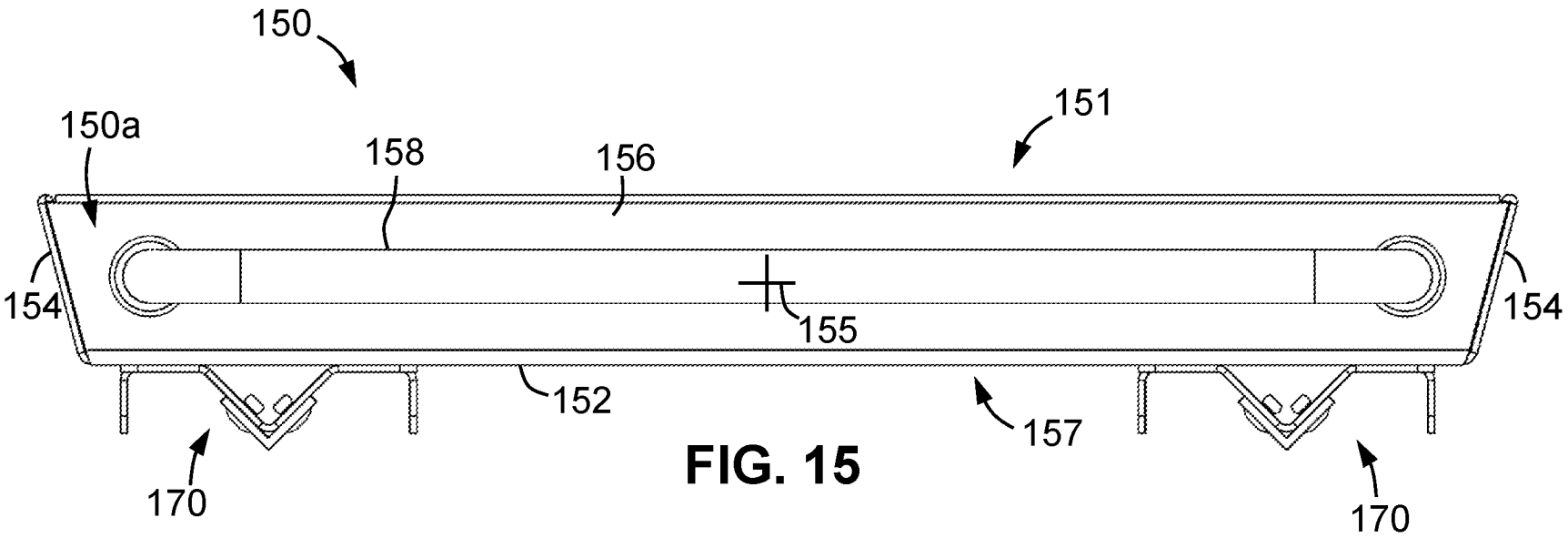
FIG. 15 is a front view of the storage pan of FIG. 13 according to some embodiments disclosed herein.
Figure 16:
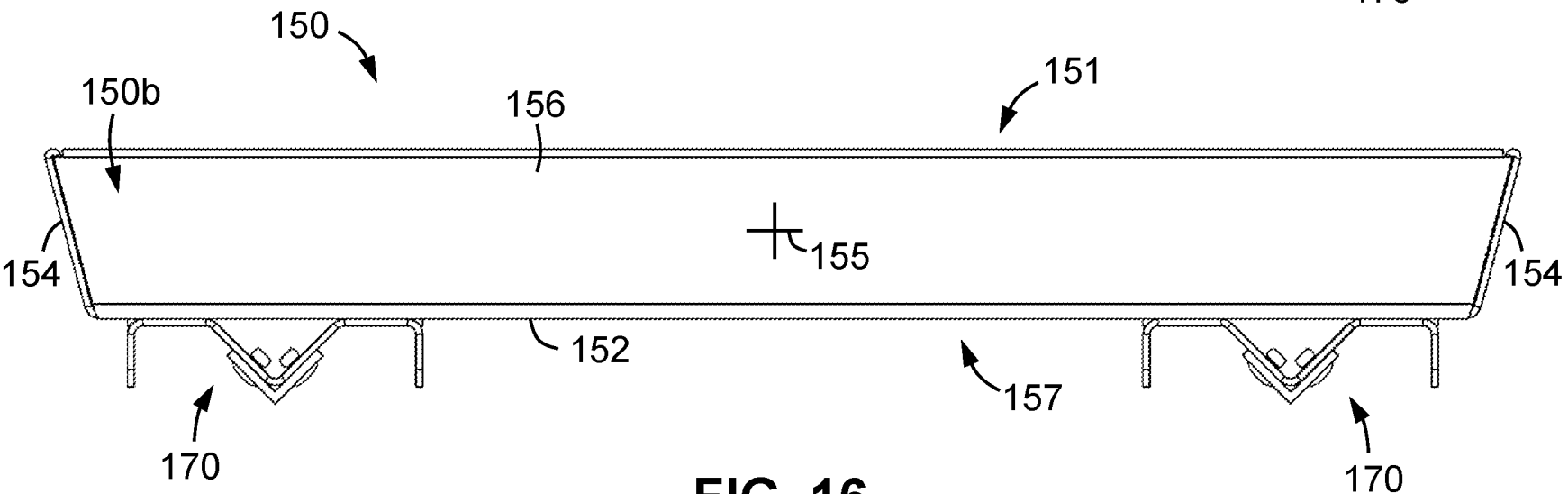
FIG. 16 is a back view of the storage pan of FIG. 13 according to some embodiments disclosed herein.
Figure 17:
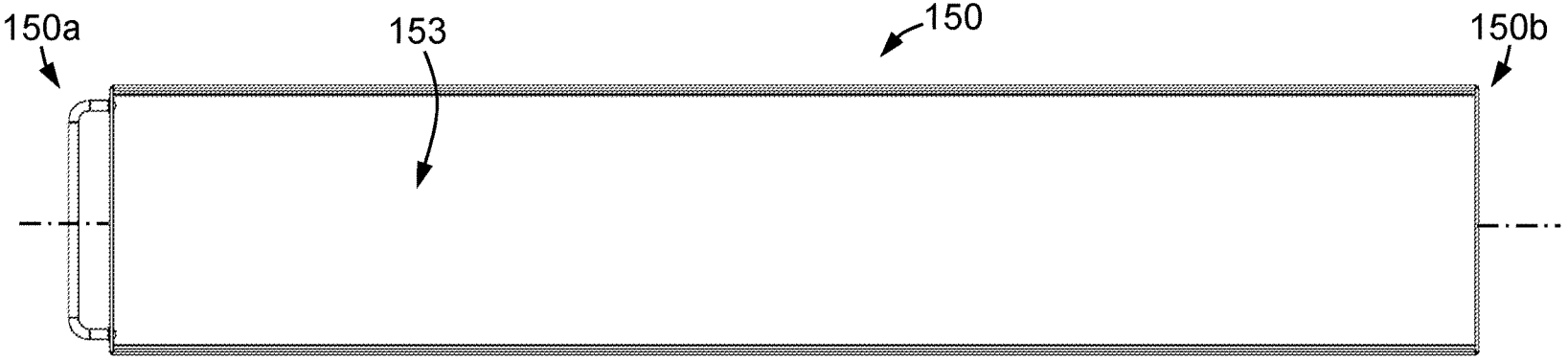
FIG. 17 is a top view of the storage pan of FIG. 13 according to some embodiments disclosed herein.
Figure 18:
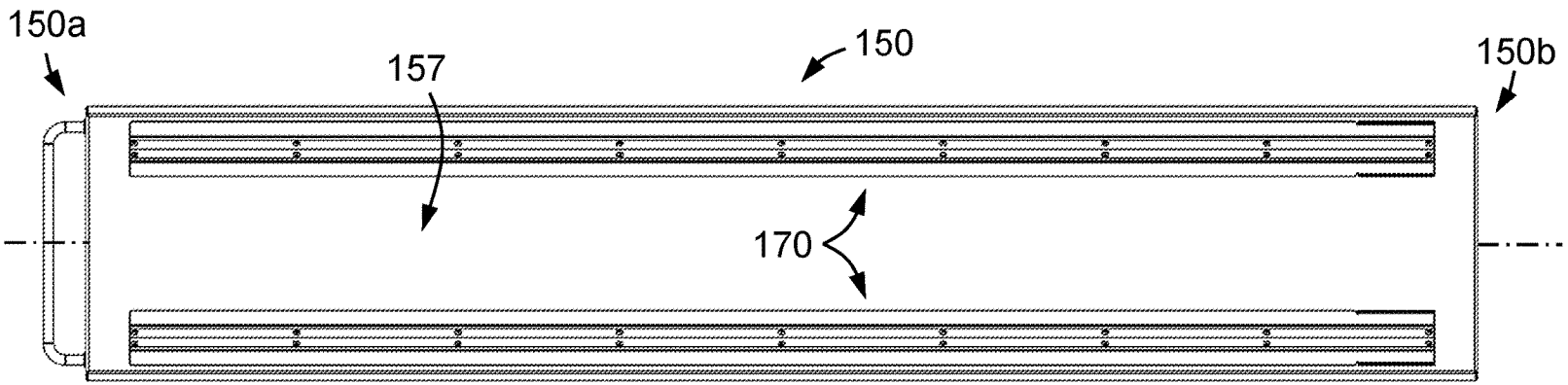
FIG. 18 is a bottom view of the storage pan of FIG. 13 according to some embodiments disclosed herein.
Figure 19:
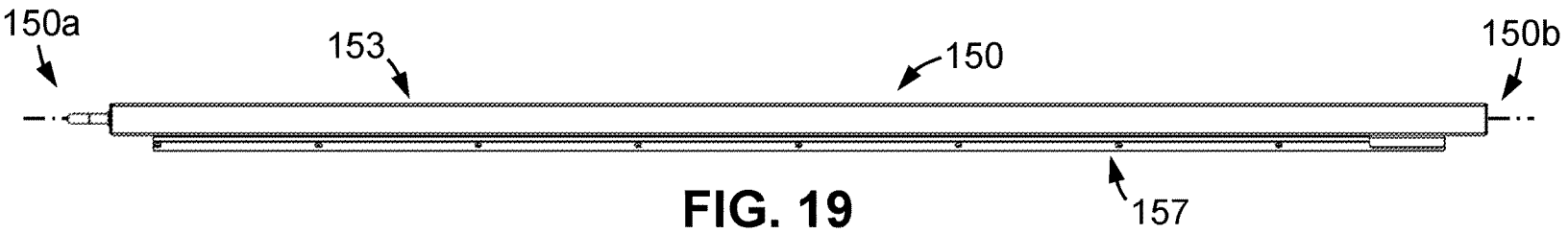
FIG. 19 is a side view of the storage pan of FIG. 13 according to some embodiments disclosed herein.

Referring still to FIGS. 13-20, the storage pan 150 also includes one or more (such as a pair of) elongate runners 170 that extend both along below the base 152 on the bottom side 157. In addition, the elongate runners 170 extend axially along the base 152 relative to the central axis 155. As shown in FIG. 14, each of the elongate runners 170 includes a first or front end 170*a* and a second or back end 170*b* that is spaced from the front end 170*a* along the longitudinal axis 155. The front end 170*a* is positioned at or near the front end 150*a* of the storage pan 150, and the back end 170*b* is positioned at or near the back end 150*b* of the storage pan 150. In addition, each of the runners 170 includes a stop assembly 180 that is positioned at or near the back end 170*b*.

Figure 21:
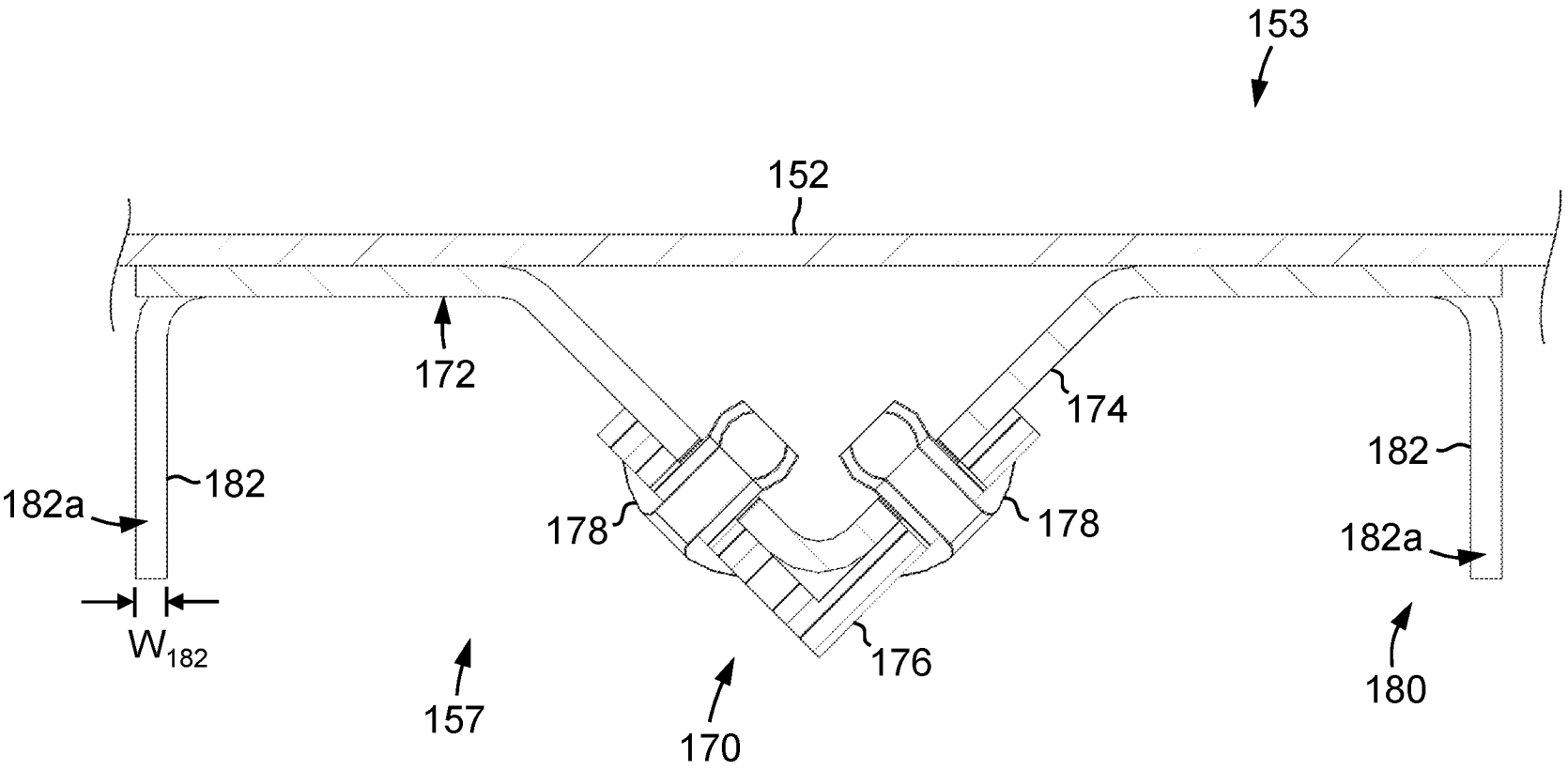
FIG. 21 is an enlarged cross-sectional view of one of the elongate runners of the storage pan of FIG. 13 according to some embodiments disclosed herein.
Figure 22:
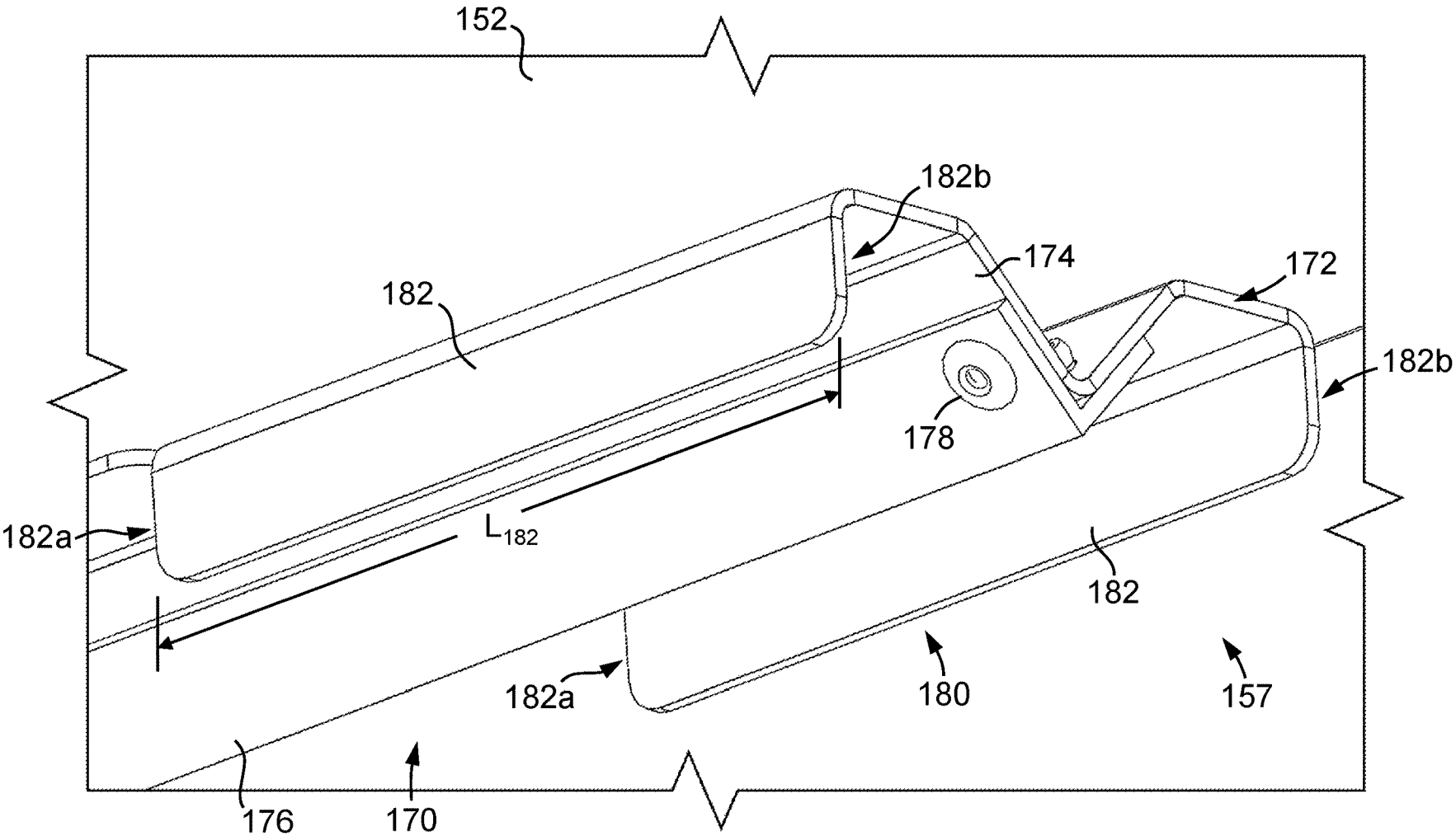
FIG. 22 is a perspective view of a back end of one of the elongate runners of the storage pan of FIG. 13 according to some embodiments disclosed herein.

Referring now to FIGS. 21 and 22, each runner 170 includes a frame 172 that is mounted to the base 152 along the bottom side 157. The frame includes a triangular projection 174 that, as shown in FIG. 21, is V-shaped in radial or lateral cross-section relative to the central axis 155 (FIGS. 14 and 20). The frame 172 may comprise a metallic material, such as aluminum or stainless steel in some embodiments.

In addition, each runner 170 includes an engagement ski 176 that is coupled to the frame 172 and particularly coupled to the triangular projection 174. The engagement ski 176 includes a triangular shape and V-shaped radial cross-section (FIG. 21) so that the engagement ski 176 may generally conform and cover the triangular projection 174. The engagement ski 176 may be secured to the triangular projection 174 via a plurality of engagement members 178 that may comprise rivets, screws, etc. In some embodiments, the engagement ski 176 may be adhered to the triangular projection 174 via an adhesive, welding, brazing, etc.

The engagement ski 176 may comprise a polymer material, such as, for instance, polytetrafluoroethylene (PTFE), ultra-high-molecular-weight (UHMW) polyethylene, etc. Without being limited to this or any other theory, constructing the engagement ski 176 out of a lower friction polymer material may allow the engagement skis 176 to more easily slide along a support surface, such as the guide surfaces 134 of the guides 130, 131 as described in more detail below. In addition, the lower friction polymer material forming the engagement ski 176 may be less prone to ice formation thereon, such as when the surrounding ambient environment 5 of the corresponding cold storage system 10 is exposed to the cold temperatures within the chamber 12 as previously described (FIG. 1).

As shown in FIG. 22, the stop assembly 180 may include one or more elongate stop walls 182 that extend downward and away from the base 152 along the bottom side 157 (e.g., in a radial direction with respect to the longitudinal axis 155). The stop walls 182 are each elongated in an axial direction with respect to the axis 155 (FIGS. 13-20) and thus extend parallel to the elongate runners 170. Thus, each of the stop walls 182 includes a width $W_{182}$ that is substantially less than its length $L_{182}$. The width $W_{182}$ is measured in a direction that is perpendicular to the corresponding runner 170 (and thus in a radial direction or plane with respect to the longitudinal axis 155), while the length $L_{182}$ is measured axially along the stop wall 182 relative to the longitudinal axis 155 (FIGS. 13-20). In some embodiments, the width $W_{182}$ may range from about 0.050 inches (in) to about 0.078 in. In addition, in some embodiments, the length $L_{182}$ may have a value that ranges from about 5% to about 97% of an axial length of the corresponding elongate runner 170 (e.g., measured in a direction that is parallel to the axis 155 between ends 170*a*, 170*b*), which may range from about 50 in to about 60 in in some embodiments. Each stop wall 182 includes a first or front end 182*a* and a second or back end 182*b* that are spaced from one another along the length $L_{182}$.

Figure 23:
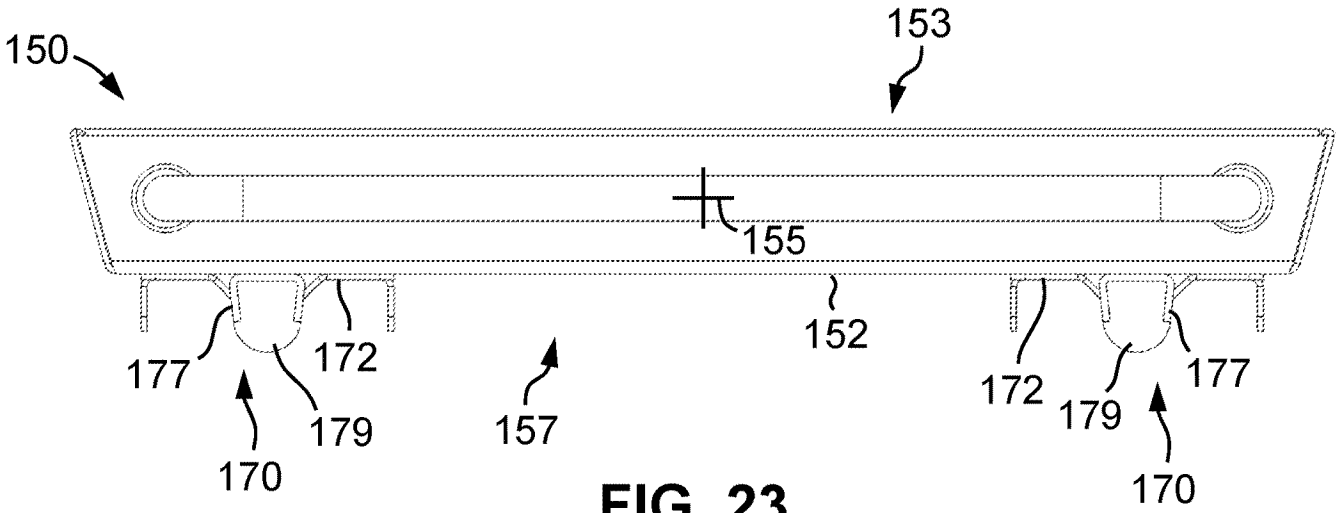
FIG. 23 is a front view of the storage pan including convex curved elongate runners according to some embodiments disclosed herein.
Figure 24:
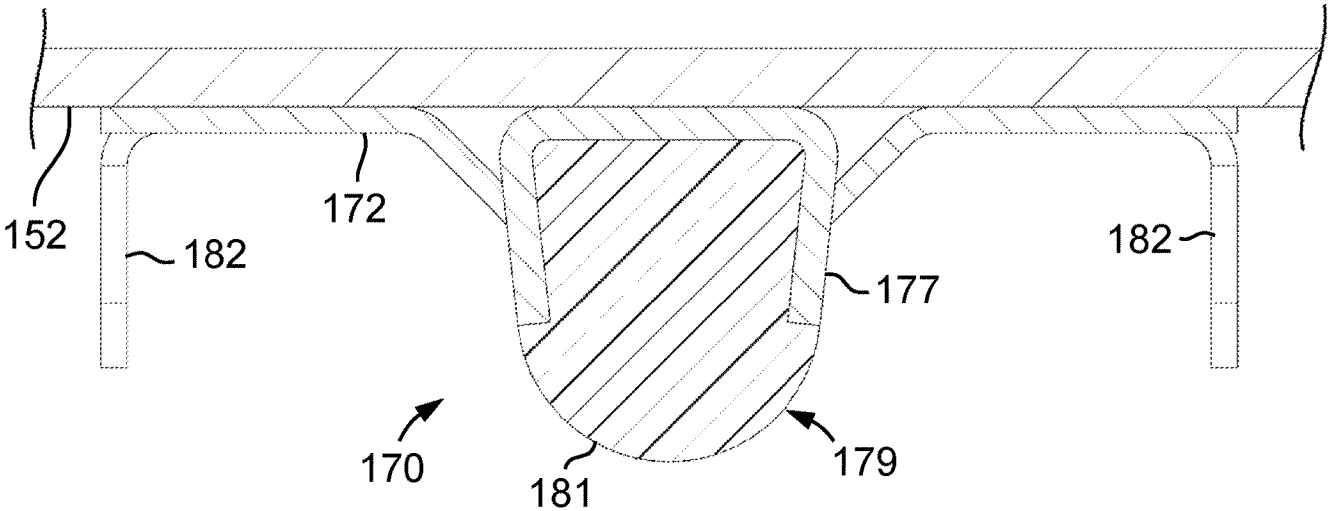
FIG. 24 is an enlarged cross-sectional view of one of the elongate runners of the storage pan of FIG. 23 according to some embodiments disclosed herein.

In some embodiments, the runners 170 may include alternative shapes (e.g., other than V-shaped as previously described). For instance, as shown in FIGS. 23 and 24, in some embodiments, the frame 172 may define or include a receptacle 177 that receives and supports an engagement ski 179 therein. In some embodiments, the engagement ski 179 may be secured within the receptacle 177 via an adhesive and/or an interference fit.

The engagement ski 179 includes a convex curved engagement surface 181. The engagement surface 181 may have a generally circular curvature such that the engagement surface 181 forms a partial cylindrical surface that extends parallel to the longitudinal axis 155. In some embodiments, the engagement surface 181 may have a non-circular curvature, such as, for instance, an elliptical curvature, a parabolic curvature, etc. As is explained for the engagement ski 176, in some embodiments, the engagement ski 179 may comprise a polymer material (e.g., PTFE, UHMW polyethylene, etc.), whereas the frame 172 and receptacle 177 both may comprise a metallic material.

Referring again to FIGS. 3 and 4, as previously described, each of the shelves 104 may support a plurality of the storage pans 150 positioned laterally adjacent one another.

Figure 25:
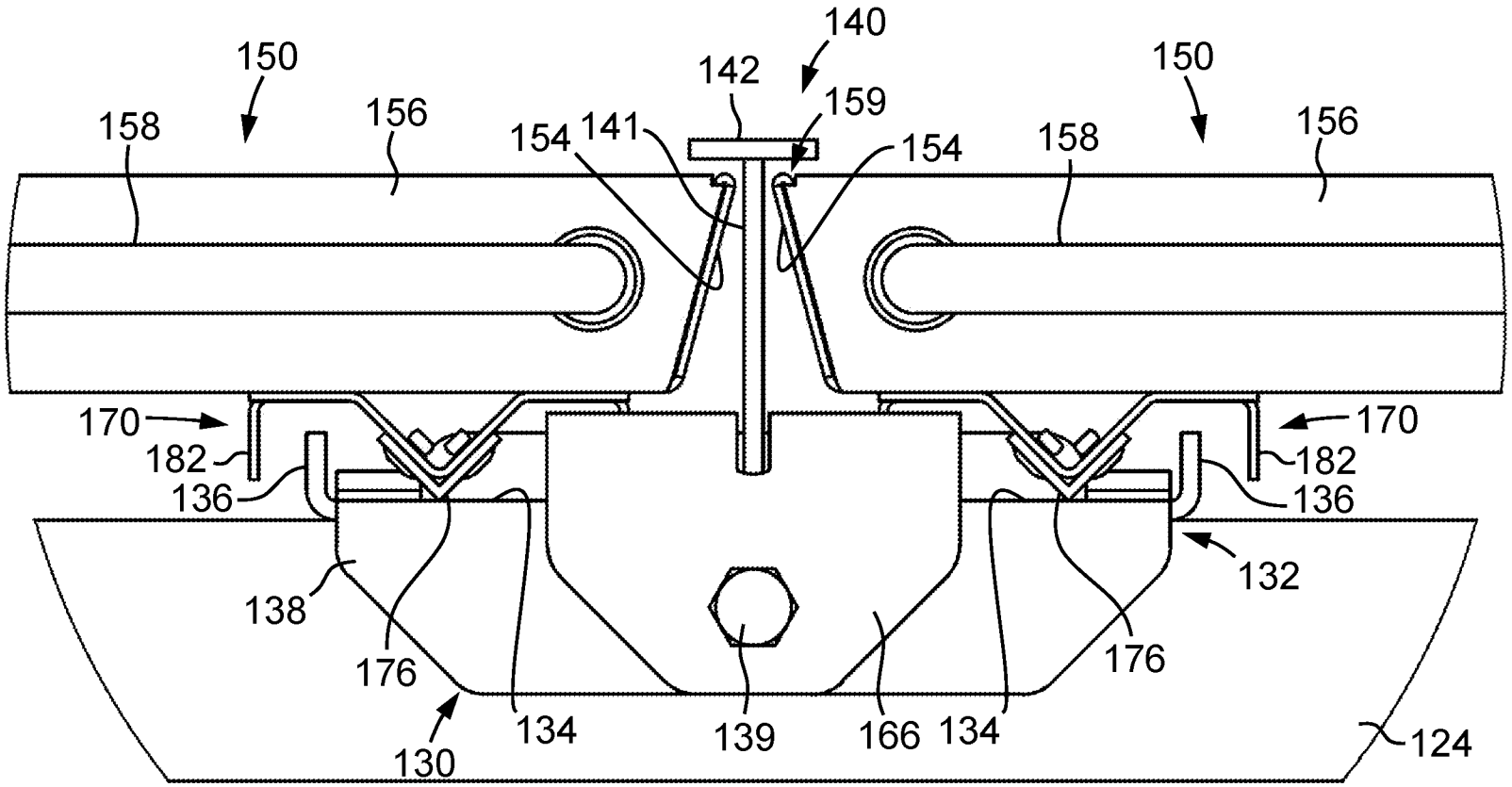
FIG. 25 is a front view of a pair of storage pans supported on a central guide of one of the shelves of the shelving assembly of FIG. 3 according to some embodiments disclosed herein.
Figure 26:
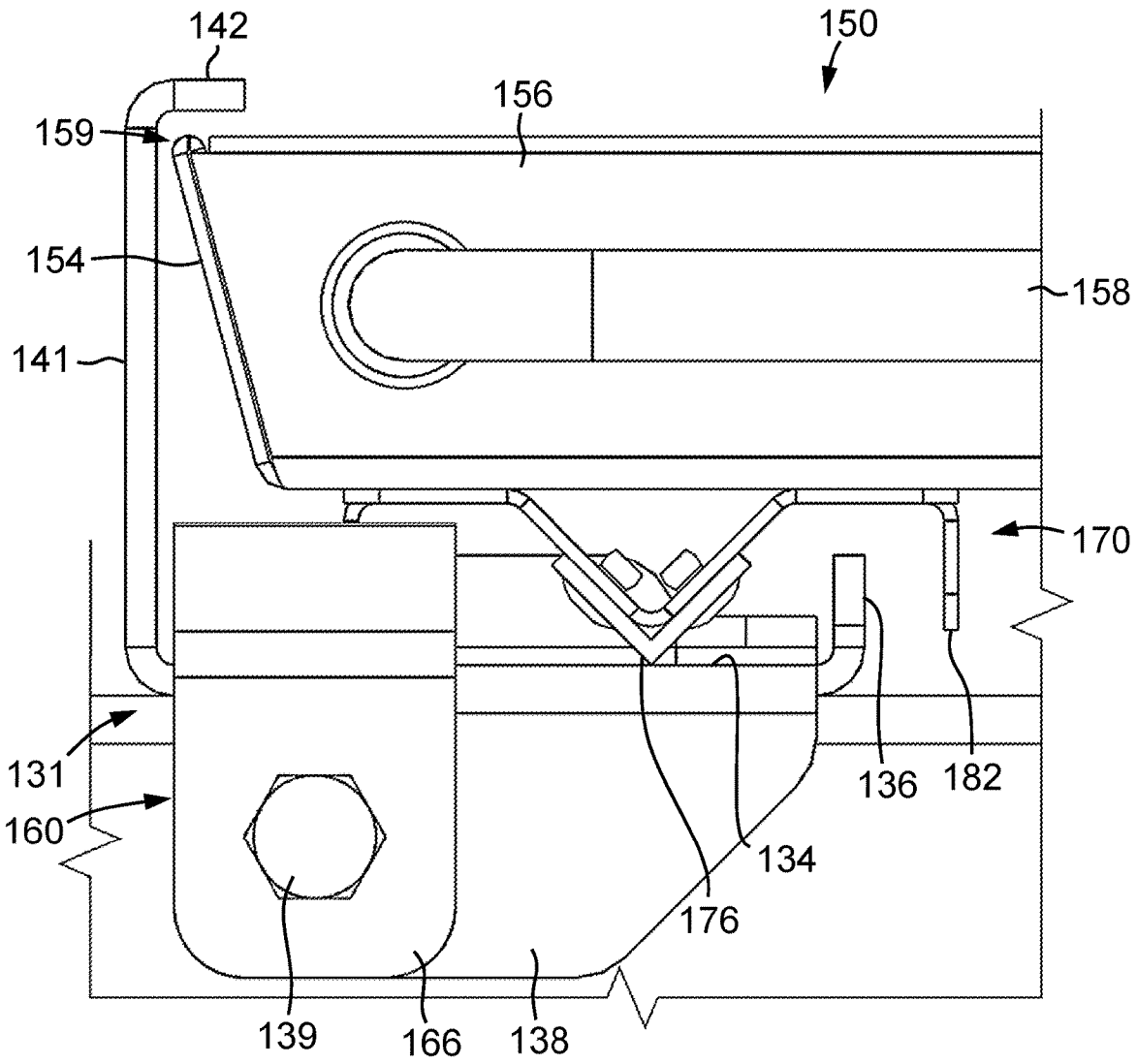
FIG. 26 a front view of a storage pan supported on a side guide of one of the shelves of the shelving assembly of FIG. 3 according to some embodiments disclosed herein.

As may be appreciated from FIGS. 4 and 9, each of the storage pans 150 may engage with and be supported on laterally adjacent central guides 130 or between one of the side guides 131 and a laterally adjacent central guide 130 along the corresponding shelf 104. In particular, as shown in FIGS. 25 and 26, the elongate runners 170 of each of the storage pans 150 may be engaged with a guide surface 134 on a corresponding one of the central guides 130 or side guides 131. The contact between the elongate runners 170 and the guide surfaces 134 of the corresponding guides 130, 131 may be limited to the engagement ski 176 (or engagement ski 179). Because the engagement ski 176 has a V-shaped cross-section (FIG. 21) (or a convexly curved engagement surface 181 for the engagement ski 179 as shown in FIG. 24), the contact between the engagement ski 176 (or engagement ski 179) and the corresponding planar guide surface 134 is minimal in surface area. In some embodiments, the contact between the engagement ski 176 (or the engagement ski 179) and the corresponding guide surface 134 may comprise line contact (e.g., along the apex or tip of the V-shaped engagement ski 176, along the convexly curved surface 181 of the engagement ski 179).

Without being limited to this or any other theory, the minimal surface area contact between the engagement skis 176, 179 on each of the plurality of storage pans 150 and the corresponding planar guide surfaces 134 coupled with the lower friction polymer material of the engagement ski 176, 179 may prevent the engagement skis 176, 179 from freezing to the guide surfaces 134 so as to help ensure the free movement or sliding of the storage pans 150 along the guides 130, 131 during operations.

Referring still to FIGS. 25 and 26, when the storage pans 150 are supported on the guides 130, 131, the lateral side walls 154 of the storage pans 150 are located proximate to the corresponding vertical riser plates 141 and flanges 142. However, because the lateral side walls 154 diverge away from one another on each of the storage pans 150 as previously described, the surface area of each of the lateral side walls 154 that is brought into close proximity of the corresponding vertical riser plate 141 is minimized and localized at the top edge 159. Ice may tend to form between surfaces areas that are brought into close proximity to one another within the chamber 12 of the cold storage system 10 (FIG. 1). Accordingly, because the opposed, proximate surface areas of the lateral side walls 154 of storage pans 150 and the vertical riser plates 141 are minimized, the risk of ice formation between the storage pans 150 and the flange assemblies 140 of the guides 130, 131 is reduced, so that the movement of storage pans 150 along the guides 130, 131 may be ensured even in the event of ice formation in the chamber 12 (FIG. 1).

In addition, as may also be appreciated from FIGS. 25 and 26, when the storage pans 150 are supported on the guides 130, 131, the top edge 159 of each of the lateral side walls 154 is positioned under a corresponding one of the flanges 142 on the corresponding guides 130, 131. Thus, during operations, if a storage pan 150 is pulled out from the corresponding shelf 104 (e.g., such as is shown in FIG. 4), the cantilevered weight of the storage pan 150 at the front end 150*a* may tend to lift the back end 150*b* upward and away from the guide surface 134. However, tipping of the storage pan 150 may be prevented by contact between the upper edge of the lateral side walls 154 and the flanges 142 on the corresponding guides 130, 131.

Figure 28:
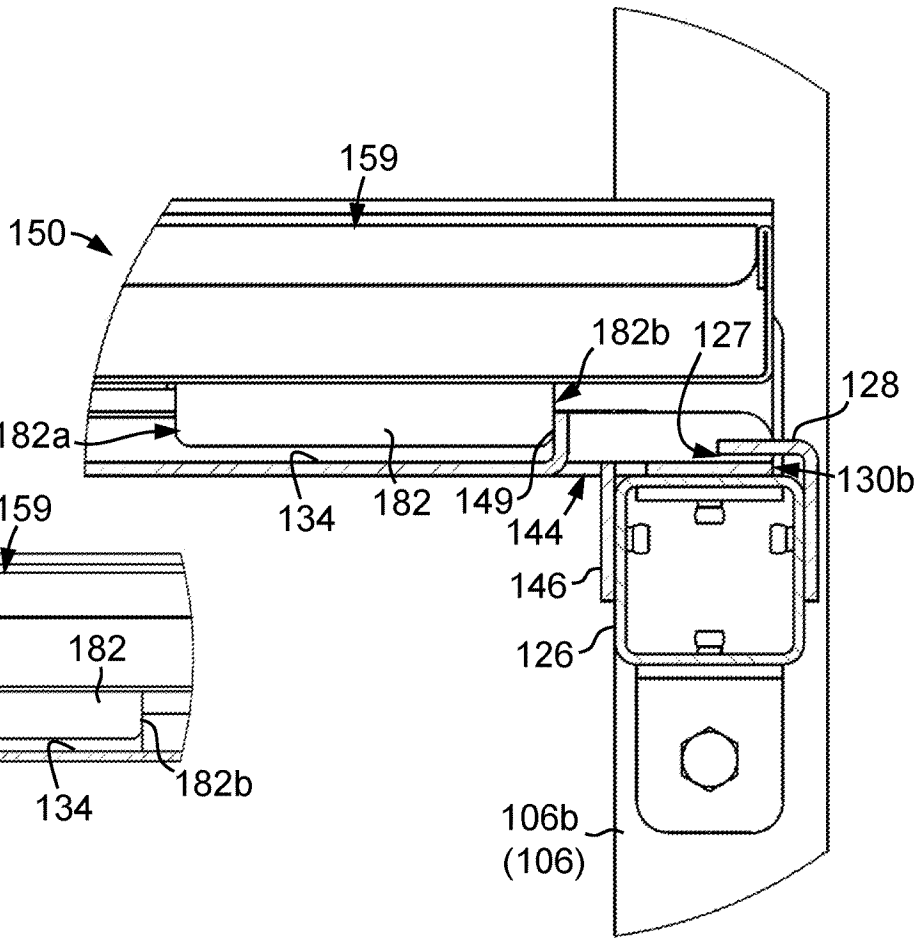
FIG. 28 is a side view of a storage pan fully inserted into the corresponding shelf of the shelving assembly of FIG. 3 according to some embodiments disclosed herein.
Figure 27:
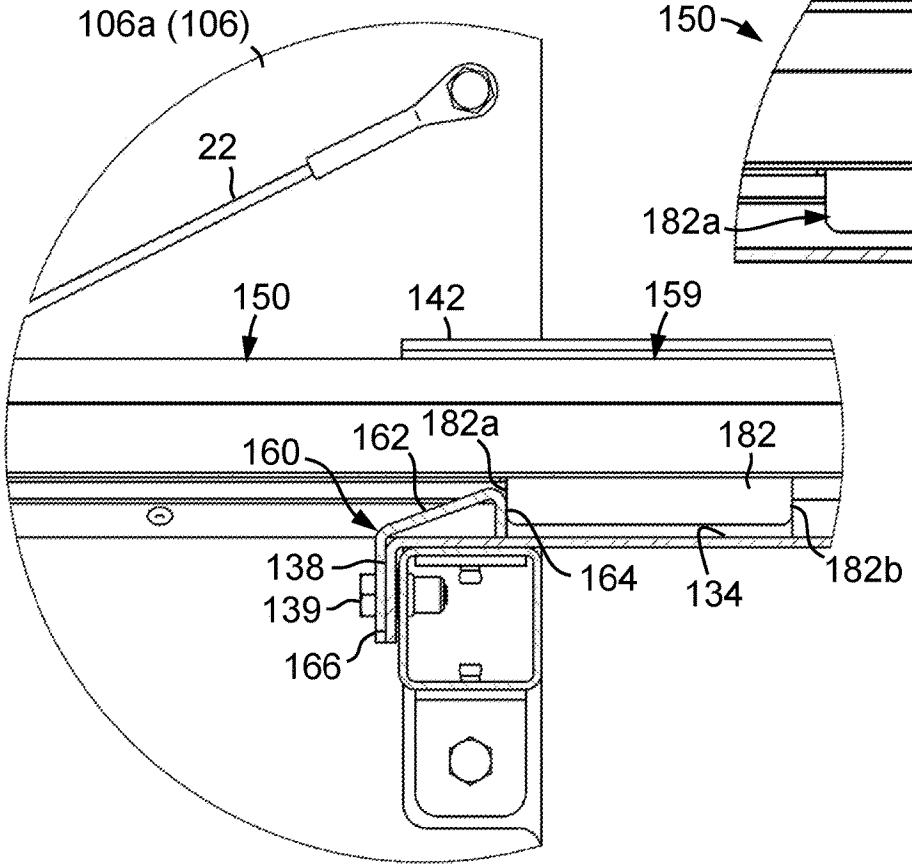
FIG. 27 is a side view of a storage pan fully pulled out from the corresponding shelf of the shelving assembly of FIG. 3 according to some embodiments disclosed herein.

Referring now to FIGS. 27 and 28, during operations, as the storage pans 150 are slid along the guides 130, 131, the stop walls 182 may selectively engage with the stop surfaces 164, 149 defined on the guides 130, 131 to limit the slidable range of the storage pans 150 on the shelves 104. In particular, as shown in FIG. 27, when any of the storage pans 150 is slid out from the corresponding shelf 104 to an extended position, the outward range of motion for the storage pan 150 is limited due to contact between the front ends 182*a* of one or more of the stop walls 182 and the front stop surface 164 on the corresponding guide 130, 131. Conversely, as shown in FIG. 28, when any of the storage pans 150 is slid back into the corresponding shelf 104 to a retracted position, the inward range of motion for the storage pan 150 is limited due to contact between the back end 182*b* of one or more of the stop walls 182 and the stop surface 149 on the corresponding guide 130, 131. Because the stop walls 182 are elongated along the longitudinal axis 155 of the storage pans 150 so that their width $W_{182}$ is substantially smaller than their length $L_{182}$ as previously described, the projected surface area of the stop walls 182 along the direction of motion (e.g., along axes 150) may be minimized so that the stop wall 182 may more easily cut through ice which may accumulate along the guides 130, 131 (particularly the planar guide surfaces 134). In addition, the minimized projected surface area of the stop walls 182 along the direction of movement may also help to reduce the amount of ice that may accumulate between the ends 182*a*, 182*b* of the stop walls 182 and the stop surfaces 164, 149. As a result, the shape and orientation of the stop walls 182 may facilitate the slidable motion of the storage pan along the guides 130, 131 even in the event of ice formation thereon.

Figure 29:
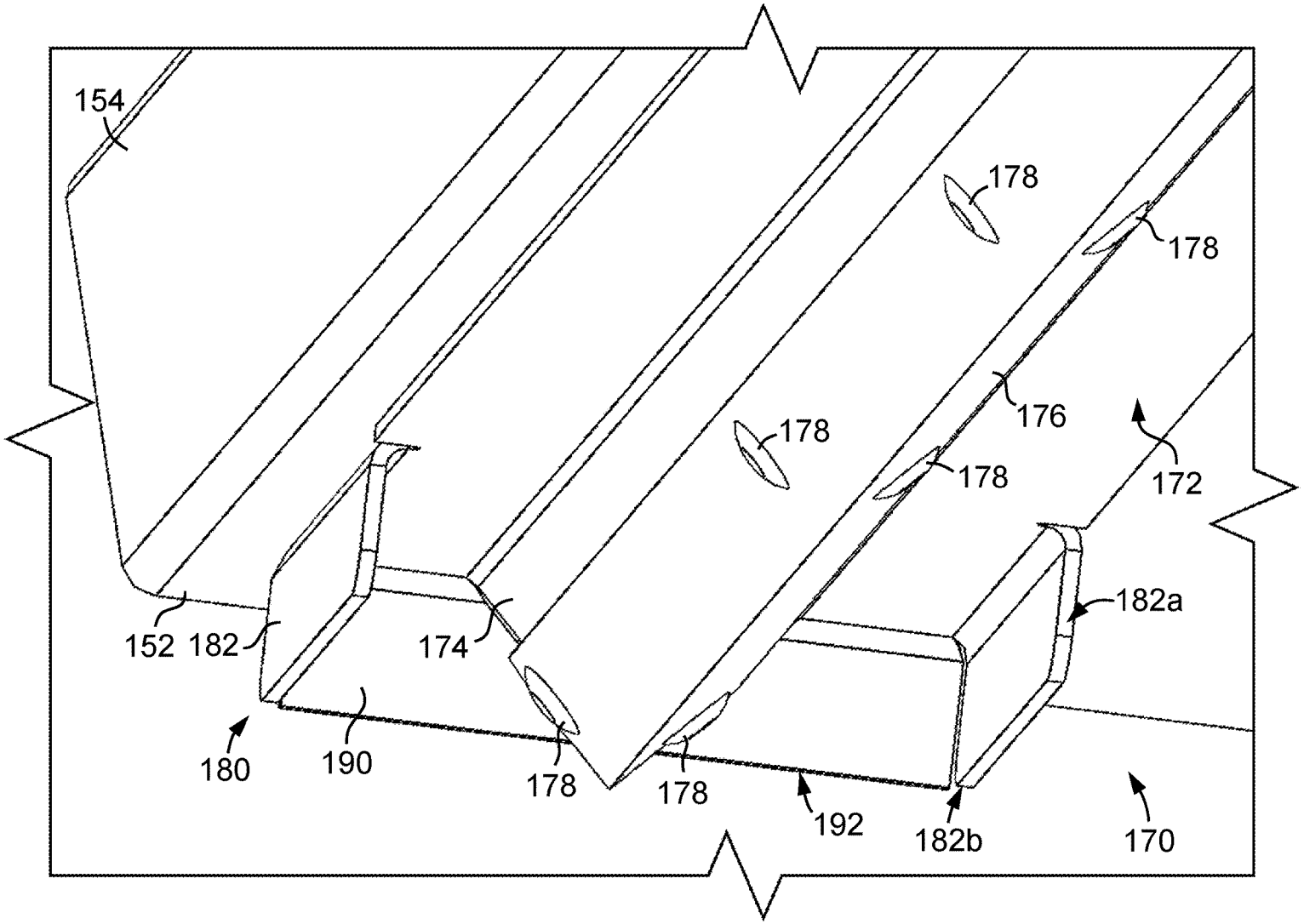
FIG. 29 is a perspective view of a back end of one of the elongate runners of a storage pan for use on the shelving assembly of FIG. 3 according to some embodiments disclosed herein.

Referring now to FIG. 29, in some embodiments, the storage pan 150 may include one or more scrapers 190 that are configured to sweep or transverse across the planar guide surface 134 of the corresponding guide 130, 131 to remove ice therefrom, and therefore mitigate ice build-up on the planar guide surface 134. In particular, in some embodiments, each scraper 190 may comprise one or more plates that extend substantially perpendicularly to one of elongate runner 170 (and thus substantially perpendicular to the direction of the longitudinal axis 155 of the corresponding storage pan 150). The scraper 190 may be positioned at or near the back end 170*b* of the corresponding runner 170 and may span between the stop walls 182. In some embodiments, the scraper 190 may comprise a pair of plates, with a first plate extending or spanning between a first of the stop walls 182 and the triangular projection 174 and engagement ski 176 and a second plate extending or spanning between a second of the stop walls 182 and the triangular projection 174 and engagement ski 176.

The plate (or plates) of each scraper 190 may include an edge 192 that is configured to engage with and dislodge ice that may have accumulated on the planar guide surface 134 of the corresponding one of the guides 130, 131 (FIGS. 25-28) during operations. In some embodiments, the edge 192 may comprise a beveled or chamfered edge. In addition, in some embodiments, the plate (or plates) of each scraper 190 may be angled or bent toward the front end 170*a* of the runner 170 such that the edge 192 may extend axially toward the front end 170*a*.

During operations, as the storage pan 150 (including the one or more scrapers 190) is pulled out from the corresponding shelf 104, the scraper 190 may engage and dislodge with ice that may have formed and/or accumulated along the planar guide surface 134 and scrape the dislodged ice toward the front end 130*a*, 131*a* of the corresponding guide 130, 131, respectively. As shown in FIG. 10, in some embodiments, the planar guide surface 134 (of any one or more of the guides 130, 131) may include one or more vertically extending apertures 194 that are positioned proximate (or near) the front end 130*a*, 131*a*, so that as the storage pan 150 is pulled out from the corresponding shelf 104, any (or at least some of the) ice that has been scrapped along the planar guide surface 134 may fall through the aperture 194 toward the bottom of the chamber 12 (FIG. 1). In some embodiments, the scraper(s) 190 may be positioned so as to push any dislodged and scrapped ice off the front end 130*a*, 131*a* of the corresponding guide 130, 131, respectively, so that the ice may fall outside the chamber 12 (FIG. 1) during operations.

Referring again to FIGS. 1-5, in some embodiments, the shelving assembly 100 (or one or more components thereof, including for instance, the frame 102, storage pans 150, interior doors 110, etc., may comprise a metallic material, such as for instance stainless steel, aluminum, or some combination thereof. In some embodiments, the selected metallic material (or material combinations) may comprise a sufficiently high thermal (or heat) capacitance so that the components of the shelving assembly 100 may resist temperature change. While a high thermal capacity for the shelving assembly 100 may hinder the initial cooling of the chamber 12 via the refrigeration assembly 20 (e.g., such as when the cold storage system 10 is first powered on), once the chamber 12 has achieved a desired temperature, the high thermal capacitance of the frame 102 storage pans 150, interior doors 110 may also allow these components to resist a subsequent increase in temperature (e.g., such as when the outer door 14 is opened as previously described). As a result, the high thermal capacity of the components within the chamber (e.g., shelving assembly 100, storage pans 150, interior doors 110) may help to maintain a desired temperature within the chamber 12, even in the event that the outer door 14 is opened to expose the chamber 12 to the surrounding environment 5.

As explained above and reiterated below, the present disclosure includes, without limitation, the following example implementations.

Clause 1: A cold storage system comprising: a chamber defined at least in part by an outer door; a refrigeration assembly operably coupled to the chamber, the refrigeration assembly configured to reduce a temperature within the chamber to −50° F. or lower; a metallic shelving assembly positioned in the chamber, the shelving assembly having a plurality of shelves that each comprise: a front lateral frame member; a back lateral frame member; and a guide coupled to and spanning between the front lateral frame member and the back lateral frame member, the guide including a planar, horizontal guide surface; and a storage pan positioned at least partially above the guide surface, the storage pan including an elongate runner extending below and along a bottom side of the storage pan, the elongate runner at least partially comprising a polymer and being configured to slidably engage the guide surface.

Clause 2: The cold storage system of any of the clauses, wherein the elongate runner comprises a metallic frame and a polymer engagement ski coupled to the metallic frame.

Clause 3: The cold storage system of any of the clauses, wherein the polymer engagement ski comprises polytetrafluoroethylene (PTFE).

Clause 4: The cold storage system of any of the clauses, wherein the polymer engagement ski has a V-shaped lateral cross-section.

Clause 5: The cold storage system of any of the clauses, wherein the polymer engagement ski has a convex curved engagement surface.

Clause 6: The cold storage system of any of the clauses, wherein the storage pan includes a stop wall positioned along the bottom side, wherein the stop wall is an elongate member having a front end and a back end and that extends parallel to the elongate runner, wherein guide includes a front stop surface and a back stop surface, and wherein the storage pan is configured to transition between: a retracted position in which the back end of the stop wall is engaged with the back stop surface; and an extended position in which the front end of the stop wall is engaged with the front stop surface.

Clause 7: The cold storage system of any of the clauses, wherein the storage pan further comprises a scraper positioned along the bottom side and extending substantially perpendicular to the elongate runner, and wherein the scraper is configured to translate along the guide surface when the storage pan is transitioned between the retracted position and the extended position to remove ice from the guide surface.

Clause 8: The cold storage system of any of the clauses, wherein the storage pan includes a base and a pair of lateral side walls, and wherein the pair of lateral side walls extend upward from the base and diverge laterally away from one another.

Clause 9: The cold storage system of any of the clauses, wherein the guide comprises a lateral flange vertically spaced above the guide surface, and wherein an upper edge of one of the pair of lateral side walls is positioned below the lateral flange.

Clause 10: The cold storage system of any of the clauses, wherein each of the plurality of shelves of the shelving assembly further comprises an interior door that is configured to transition between a closed position to occlude a corresponding one of the plurality of shelves and an open position to expose the corresponding one of the plurality of shelves.

Clause 11: The cold storage system of any of the clauses, wherein each of the plurality of shelves of the shelving assembly includes a magnet that is configured to maintain the corresponding interior door in the closed position.

Claus 12: The cold storage system of any of the clauses, wherein each interior door comprises: a top edge; a bottom edge; and a pivot connection positioned closer to the bottom edge than the top edge that pivotably supports the interior door on the shelving assembly such that the top edge rotates outward and away from the corresponding one of the plurality of shelves when the interior door transitions from the closed position to the open position.

Clause 13: A cold storage system, comprising: a housing that defines a chamber, the housing including an outer door configured to provide access into the chamber; a refrigeration assembly coupled to the housing that is configured to achieve an ultra-low temperature within the chamber via forced convection; a plurality of shelves vertically spaced from one another within the chamber to provide airflow gaps between the shelves, each shelf of the plurality of shelves comprising a plurality of lateral guides that are laterally spaced from one another to define airflow openings vertically through each shelf individually; a plurality of interior doors positioned within the chamber, each of the plurality of interior doors being aligned with a corresponding shelf of the plurality shelves and configured to transition between: a closed position in which the interior door occludes the corresponding shelf and obstructs airflow from the corresponding shelf out of the chamber when the outer door is open; and an open position in which the interior door is pivoted from the closed position to expose the corresponding shelf; and a plurality of storage pans supported on the plurality of guides in each of the plurality of shelves, wherein each of the plurality of storage pans is configured to slide out from the corresponding shelf to be at least partially supported by a corresponding interior door of the plurality of interior doors when the corresponding interior door is in the open position.

Clause 14: The cold storage system of any of the clauses, wherein each of the plurality of shelves further comprises a plurality of lateral frame members, wherein the plurality of guides of each shelf are coupled to and span between the plurality of lateral frame members, and wherein the plurality of lateral frame members and the plurality of guides of each of the plurality of shelves comprise a metallic material.

Clause 15: The cold storage system of any of the clauses, wherein the metallic material comprises stainless steel such that the metallic material is configured to maintain the temperature within the chamber when the outer door is open.

Clause 16: The cold storage system of any of the clauses, wherein each of the plurality of guides includes a planar guide surface, and wherein each of the plurality of storage pans includes a V-shaped runner extending along a bottom side of the storage pan that is configured to slidably engage with the planar guide surface of a corresponding one of the plurality of guides.

Clause 17: The cold storage system of any of the clauses, wherein the V-shaped runner of each of the plurality of storage pans comprises a metallic frame and an engagement ski coupled to the metallic frame that comprises polytetrafluoroethylene (PTFE).

Clause 18: The cold storage system of any of the clauses, wherein each of the plurality of storage pans includes a stop wall positioned along the bottom side, wherein the stop wall is an elongate member that extends parallel to the V-shaped runner, and wherein stop wall is to engage with stop surfaces defined on the corresponding one of the plurality of guides to limit a slidable range of the storage pan along the corresponding shelf of the plurality of shelves.

Clause 19: The cold storage system of any of the clauses, wherein each of the plurality of storage pans includes a scraper positioned along the bottom side, and wherein the scraper is configured to translate across the planar guide of the corresponding one of the plurality of guides to remove ice from the planar guide surface when the storage pan is slid out from the corresponding shelf.

Clause 20: The cold storage system of any of the clauses, wherein each of the plurality of guides includes a guide surface and a lateral flange vertically spaced above the guide surface, wherein each of the plurality of storage pans is supported on the guide surface of at least one of the corresponding guides such that at least a portion of an upper edge of the storage pan is positioned under the lateral flange, and wherein each of the plurality of storage pans includes a base and a pair of lateral side walls extending upward from the base and diverging laterally away from one another.

As previously described, the embodiments disclosed herein are directed to cold storage systems that include shelving assemblies configured to help maintain a desired temperature in an inner storage chamber when an outer door of the inner storage chamber is opened. In addition, the shelving assemblies of the embodiments disclosed herein may also be configured to maintain freedom of movement of moving components thereof, even when ice formation occurs. Thus, the embodiments disclosed herein may enhance the functional performance of a cold storage system, and especially cold storage systems that are configured to achieve ultra-low temperatures.

While some embodiments described herein include a cold storage system 10 having a pair of external doors 14 that provide access into a chamber 12 and a pair of shelving assemblies 100 positioned within the chamber 12 as shown in FIG. 1, in other embodiments, different numbers of chambers 12, external doors 14, and shelving assemblies 100 may be included in the cold storage system 10. For instance, in some embodiments, a cold storage system 10 may include a single chamber 12 that is accessed via a single external door 14 and that includes a single shelving assembly 100 positioned therein.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cold storage system comprising:

a chamber defined at least in part by an outer door;

a refrigeration assembly operably coupled to the chamber, the refrigeration assembly configured to reduce a temperature within the chamber to −50° F. or lower;

a metallic shelving assembly positioned in the chamber, the shelving assembly having a plurality of shelves that each comprise:

a front lateral frame member;

a back lateral frame member; and a guide coupled to and spanning between the front lateral frame member and the back lateral frame member, the guide including a planar, horizontal guide surface; and a storage pan positioned at least partially above the guide surface, the storage pan including an elongate runner extending below and along a bottom side of the storage pan, the elongate runner including a metallic frame and a polymer engagement ski coupled to the metallic frame, and the elongate runner being configured to slidably engage the guide surface.

2. The cold storage system of claim 1, wherein the polymer engagement ski comprises polytetrafluoroethylene (PTFE).

3. The cold storage system of claim 2, wherein the polymer engagement ski has a V-shaped lateral cross-section.

4. The cold storage system of claim 2, wherein the polymer engagement ski has a convex curved engagement surface.

5. The cold storage system of claim 1, wherein the storage pan includes a stop wall positioned along the bottom side, wherein the stop wall is an elongate member having a front end and a back end and that extends parallel to the elongate runner, wherein the guide includes a front stop surface and a back stop surface, and wherein the storage pan is configured to transition between:

a retracted position in which the back end of the stop wall is engaged with the back stop surface; and an extended position in which the front end of the stop wall is engaged with the front stop surface.

6. The cold storage system of claim 5, wherein the storage pan further comprises a scraper positioned along the bottom side and extending substantially perpendicular to the elongate runner, and wherein the scraper is configured to translate along the guide surface when the storage pan is transitioned between the retracted position and the extended position to remove ice from the guide surface.

7. The cold storage system of claim 1, wherein the storage pan includes a base and a pair of lateral side walls, and wherein the pair of lateral side walls extend upward from the base and diverge laterally away from one another.

8. The cold storage system of claim 7, wherein the guide comprises a lateral flange vertically spaced above the guide surface, and wherein an upper edge of one of the pair of lateral side walls is positioned below the lateral flange.

9. The cold storage system of claim 1, wherein each of the plurality of shelves of the shelving assembly further comprises an interior door that is configured to transition between a closed position to occlude a corresponding one of the plurality of shelves and an open position to expose the corresponding one of the plurality of shelves.

10. The cold storage system of claim 9, wherein each of the plurality of shelves of the shelving assembly includes a magnet that is configured to maintain the corresponding interior door in the closed position.

11. The cold storage system of claim 9, wherein each interior door comprises:

a top edge;

a bottom edge; and a pivot connection positioned closer to the bottom edge than the top edge that pivotably supports the interior door on the shelving assembly such that the top edge rotates outward and away from the corresponding one of the plurality of shelves when the interior door transitions from the closed position to the open position.

12. The cold storage system of claim 9, wherein the storage pan is configured to slide out from the corresponding shelf to be at least partially supported by a corresponding interior door when the corresponding interior door is in the open position.

13. The cold storage system of claim 1, wherein the front lateral frame member, the back lateral frame member, and the guide of the plurality of shelves are a metallic material.

14. The cold storage system of claim 13, wherein the metallic material comprises stainless steel such that the metallic material is configured to maintain the temperature within the chamber when the outer door is open.

15. A cold storage system comprising:

a housing that defines a chamber, the housing including an outer door configured to provide access into the chamber;

a refrigeration assembly coupled to the housing that is configured to achieve an ultra-low temperature within the chamber via forced convection;

a plurality of shelves vertically spaced from one another within the chamber to provide airflow gaps between the shelves, each shelf of the plurality of shelves comprising a plurality of guides that are laterally spaced from one another to define airflow openings vertically through each shelf individually, wherein each of the plurality of guides includes a planar guide surface;

a plurality of interior doors positioned within the chamber, each of the plurality of interior doors being aligned with a corresponding shelf of the plurality shelves and configured to transition between:

a closed position in which the interior door occludes the corresponding shelf and obstructs airflow from the corresponding shelf out of the chamber when the outer door is open; and an open position in which the interior door is pivoted from the closed position to expose the corresponding shelf; and a plurality of storage pans supported on the plurality of guides in each of the plurality of shelves, wherein each of the plurality of storage pans is configured to slide out from the corresponding shelf to be at least partially supported by a corresponding interior door of the plurality of interior doors when the corresponding interior door is in the open position, wherein each of the plurality of storage pans includes a V-shaped runner extending along a bottom side of the storage pan that is configured to slidably engage with the planar guide surface of a corresponding one of the plurality of guides, and wherein the V-shaped runner of each of the plurality of storage pans comprises a metallic frame and an engagement ski coupled to the metallic frame that comprises polytetrafluoroethylene (PTFE).

16. The cold storage system of claim 15, wherein each of the plurality of shelves further comprises a plurality of lateral frame members, wherein the plurality of guides of each shelf are coupled to and span between the plurality of lateral frame members, and wherein the plurality of lateral frame members and the plurality of guides of each of the plurality of shelves comprise a metallic material.

17. The cold storage system of claim 16, wherein the metallic material comprises stainless steel such that the metallic material is configured to maintain the temperature within the chamber when the outer door is open.

18. The cold storage system of claim 15, wherein each of the plurality of storage pans includes a stop wall positioned along the bottom side, wherein the stop wall is an elongate member that extends parallel to the V-shaped runner, and wherein the stop wall is to engage with stop surfaces defined on the corresponding one of the plurality of guides to limit a slidable range of the storage pan along the corresponding shelf of the plurality of shelves.

19. The cold storage system of claim 15, wherein each of the plurality of storage pans includes a scraper positioned along the bottom side, and wherein the scraper is configured to translate across the planar guide of the corresponding one of the plurality of guides to remove ice from the planar guide surface when the storage pan is slid out from the corresponding shelf.

20. The cold storage system of claim 15, wherein each of the plurality of guides includes a guide surface and a lateral flange vertically spaced above the guide surface, wherein each of the plurality of storage pans is supported on the guide surface of at least one of the corresponding guides such that at least a portion of an upper edge of the storage pan is positioned under the lateral flange, and wherein each of the plurality of storage pans includes a base and a pair of lateral side walls extending upward from the base and diverging laterally away from one another.

* * * * *